US010053943B2

(12) United States Patent
Hannegan et al.

(10) Patent No.: US 10,053,943 B2
(45) Date of Patent: Aug. 21, 2018

(54) ANNULAR SEALING FOR USE WITH A WELL

(71) Applicant: WEATHERFORD TECHNOLOGY HOLDINGS, LLC, Houston, TX (US)

(72) Inventors: Don M. Hannegan, Fort Smith, AR (US); James W. Chambers, Houston, TX (US); Melvin T. Jacobs, Fort Smith, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 106 days.

(21) Appl. No.: 15/171,549

(22) Filed: Jun. 2, 2016

(65) Prior Publication Data

US 2016/0273297 A1 Sep. 22, 2016

Related U.S. Application Data

(63) Continuation of application No. 13/730,489, filed on Dec. 28, 2012, now abandoned.

(60) Provisional application No. 61/581,427, filed on Dec. 29, 2011.

(51) Int. Cl.

| | |
|---|---|
| ***E21B 33/03*** | (2006.01) |
| ***E21B 33/06*** | (2006.01) |
| ***E21B 33/08*** | (2006.01) |
| ***E21B 33/068*** | (2006.01) |

(52) U.S. Cl.
CPC ..... *E21B 33/06* (2013.01); *E21B 33/068* (2013.01); *E21B 33/085* (2013.01)

(58) Field of Classification Search
CPC ..... E21B 33/03; E21B 33/04; E21B 33/08; E21B 33/085; E21B 33/02
USPC ..... 277/322, 343
See application file for complete search history.

(56) References Cited

U.S. PATENT DOCUMENTS

| | | | |
|---|---|---|---|
| 1,901,031 | A | 3/1933 | Humason |
| 2,458,270 | A | 1/1949 | Humason |
| 2,682,068 | A | 6/1954 | Harrigan |
| 3,023,012 | A | 2/1962 | Wilde |
| 3,583,480 | A | 6/1971 | Regan |
| 4,428,592 | A | 1/1984 | Shaffer |
| 4,647,050 | A | 3/1987 | Johnson |
| 4,981,174 | A | 1/1991 | White |

(Continued)

FOREIGN PATENT DOCUMENTS

| | | |
|---|---|---|
| CA | 2575477 A1 | 7/2008 |
| EP | 2285563 B1 | 11/2011 |

(Continued)

OTHER PUBLICATIONS

Australian Examination Report dated Jan. 13, 2017 for AU Patent Application No. 2012362225, 7 pages.

(Continued)

*Primary Examiner* — Kenneth L Thompson
(74) *Attorney, Agent, or Firm* — Smith IP Services, P.C.

(57) ABSTRACT

An annular seal having a sealing member and method for use is provided for sealing an item of oilfield equipment. The annular seal has an inner diameter for receiving the item of oilfield equipment and a frame. The seal member is contiguous with the frame. The annular seal is configured for durability, in that it resists wear, inversion, increases lubricity, enables tightness, and/or otherwise generally increases endurance, toughness, and/or permanence.

33 Claims, 20 Drawing Sheets

(56) References Cited

U.S. PATENT DOCUMENTS

| | | | | |
|---|---|---|---|---|
| 5,062,479 | A | 11/1991 | Bailey et al. | |
| 5,224,557 | A | 7/1993 | Yenulis et al. | |
| 5,343,944 | A | 9/1994 | Bassinger et al. | |
| 5,348,107 | A | 9/1994 | Bailey et al. | |
| 5,474,097 | A | 12/1995 | Lowe et al. | |
| 5,538,080 | A | 7/1996 | Bassinger | |
| 5,549,156 | A * | 8/1996 | Borden | E21B 33/08 166/84.2 |
| 5,636,688 | A | 6/1997 | Bassinger | |
| 5,647,444 | A | 7/1997 | Williams | |
| 5,662,181 | A | 9/1997 | Williams et al. | |
| 5,803,169 | A | 9/1998 | Bassinger et al. | |
| 5,901,964 | A | 5/1999 | Williams et al. | |
| 5,944,099 | A * | 8/1999 | Sas-Jaworsky | E21B 19/22 166/77.2 |
| 6,230,824 | B1 | 5/2001 | Peterman et al. | |
| 6,325,159 | B1 | 12/2001 | Peterman et al. | |
| 6,910,531 | B2 | 6/2005 | Smith, Jr. | |
| 6,966,386 | B2 | 11/2005 | Ringgenberg et al. | |
| 7,174,956 | B2 | 2/2007 | Williams et al. | |
| 7,237,618 | B2 | 7/2007 | Williams | |
| 7,240,727 | B2 | 7/2007 | Williams | |
| 7,377,334 | B2 | 5/2008 | May et al. | |
| 7,717,168 | B2 | 5/2010 | Williams | |
| 8,066,062 | B2 | 11/2011 | Edvardsen et al. | |
| 8,100,189 | B2 | 1/2012 | Edvardsen et al. | |
| 8,188,293 | B2 | 5/2012 | Tournilhac et al. | |
| 8,322,432 | B2 | 12/2012 | Bailey et al. | |
| 8,985,229 | B2 | 3/2015 | Edvardsen et al. | |
| 9,016,659 | B2 | 4/2015 | Huang | |
| 2001/0050185 | A1 | 12/2001 | Calder et al. | |
| 2004/0084220 | A1 | 5/2004 | Bailey et al. | |
| 2005/0183856 | A1 | 8/2005 | Williams | |
| 2006/0144622 | A1 | 7/2006 | Bailey et al. | |
| 2008/0299391 | A1 | 12/2008 | White et al. | |
| 2009/0029146 | A1 | 3/2009 | Williams | |
| 2009/0139724 | A1 | 6/2009 | Gray et al. | |
| 2010/0075134 | A1 | 3/2010 | Blaiszik et al. | |
| 2010/0218937 | A1 | 9/2010 | Edvardsen et al. | |
| 2011/0003137 | A1 | 1/2011 | Cosentino | |
| 2011/0024195 | A1 | 2/2011 | Hoyer et al. | |
| 2011/0315404 | A1 | 12/2011 | Bailey et al. | |
| 2013/0106712 | A1 | 5/2013 | Cummings et al. | |
| 2014/0027129 | A1 | 1/2014 | Hannegan et al. | |
| 2015/0369000 | A1 | 12/2015 | Leuchtenberg et al. | |

FOREIGN PATENT DOCUMENTS

| | | | |
|---|---|---|---|
| GB | 2362668 | A | 11/2001 |
| WO | 2007008085 | A1 | 1/2007 |
| WO | 2009029146 | A1 | 3/2009 |
| WO | 2011159165 | A1 | 12/2011 |
| WO | 2012127180 | A1 | 9/2012 |

OTHER PUBLICATIONS

International Search Report dated Sep. 20, 2011 for PCT Patent Application No. PCT/NO2011/000166, 3 pages.

International Search Report with Written Opinion dated Jan. 22, 2014 for PCT Patent Application No. PCT/US2012/072156, 11 pages.

Office Action dated Aug. 14, 2015 for U.S. Appl. No. 13/730,489, 22 pages.

Office Action dated Mar. 16, 2016 for U.S. Appl. No. 13/730,489, 13 pages.

Australian Examination Report dated Jun. 20, 2017 for AU Patent Application 2012362225, 4 pages.

Australian Examination Report dated Aug. 18, 2016 for AU Patent Application No. 2012362225, 3 pages.

European Search Report dated Sep. 14, 2017 for EP Patent Application No. 17162831.6, 8 pages.

* cited by examiner

ANNULAR SEALING FOR USE WITH A WELL

CROSS-REFERENCE TO RELATED APPLICATIONS

This application is a continuation of prior application Ser. No. 13/730,489 filed on 28 Dec. 2012, which claims the benefit of U.S. Provisional Application No. 61/581,427 filed Dec. 29, 2011. The entire disclosures of these prior applications are incorporated herein by this reference.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Oilfield operations may be performed in order to extract fluids from the earth. When a well site is completed, pressure control equipment may be placed near the surface of the earth. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe with tool joints, casing, drill collars, Kelly, etc.) for the purposes of controlling the pressure or fluid flow to the surface. For reference to an existing description of a rotating control device, please see US patent publication number 2009/0139724 entitled "Latch Position Indicator System and Method", US patent publication number 2011/0024195 entitled "Drilling with a High Pressure RCD", US patent publication number 2011/0315404 entitled "Lubricating Seal for use with a Tubular", U.S. Pat. No. 8,100,189, U.S. Pat. No. 8,066,062, U.S. Pat. No. 7,240,727, U.S. Pat. No. 7,237,618, U.S. Pat. No. 7,174,956, U.S. Pat. No. 5,647,444, U.S. Pat. No. 5,662,181, and U.S. Pat. No. 5,901,964 the disclosures of which are hereby incorporated by reference. The seals in the RCD are typically constructed of elastomer material and have a tendency to wear with usage. The higher the differential pressures across the annular seal, the more rapid the wear rate. Further, the seals tend to invert during pull out from the RCD, a drilling operation referred to as "stripping out". The seal may invert by bending inward and folding into itself. When the seal inverts it may fail to seal the wellbore annulus and need to be replaced. In high pressure, and/or high temperature wells the need is greater for a more robust and efficient seal to extend its useful life. In some applications or functions of a seal, a need exists to increase lubricity and consequently reduce frictional heat which accelerates elastomer wear. In others, a need exists to enhance the seal's stretch tightness on the drill string, thus assuring the transfer of torque required to rotate the inner race of the RCD's bearing assembly in harmony with components of the drill string being sealed against.

A need exists for an improved annular seal having increased endurance, toughness, and/or permanence in an RCD.

SUMMARY

An annular seal having a sealing member and method for use is provided for sealing an item of oilfield equipment. The annular seal has an inner diameter for receiving the item of oilfield equipment and a frame. The seal member is contiguous with the frame. The annular seal is configured for durability, in that it resists wear, inversion, increases lubricity, enables tightness, and/or otherwise generally increases endurance, toughness, and/or permanence.

As used herein the terms "radial" and "radially" include directions inward toward (or outward away from) the center axial direction of the drill string or item of oilfield equipment but not limited to directions perpendicular to such axial direction or running directly through the center. Rather such directions, although including perpendicular and toward (or away from) the center, also include those transverse and/or off center yet moving inward (or outward), across or against the surface of an outer sleeve of item of oilfield equipment to be engaged.

As used herein the term "additive" refers generally to enhancers to material properties such as reducing the coefficient of friction, wear resistance, crack and propagation resistance, induce self-healing, etc. and may include, but is not limited to, additives, beads, pockets, formulations added homogeneously to a material, and/or self-healing polymers and composites (capsule-based, vascular, or intrinsic). Aramid fiber/pulp, molybdenum, and wear-resistant beads are examples of "additives".

DETAILED DESCRIPTION OF PREFERRED EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
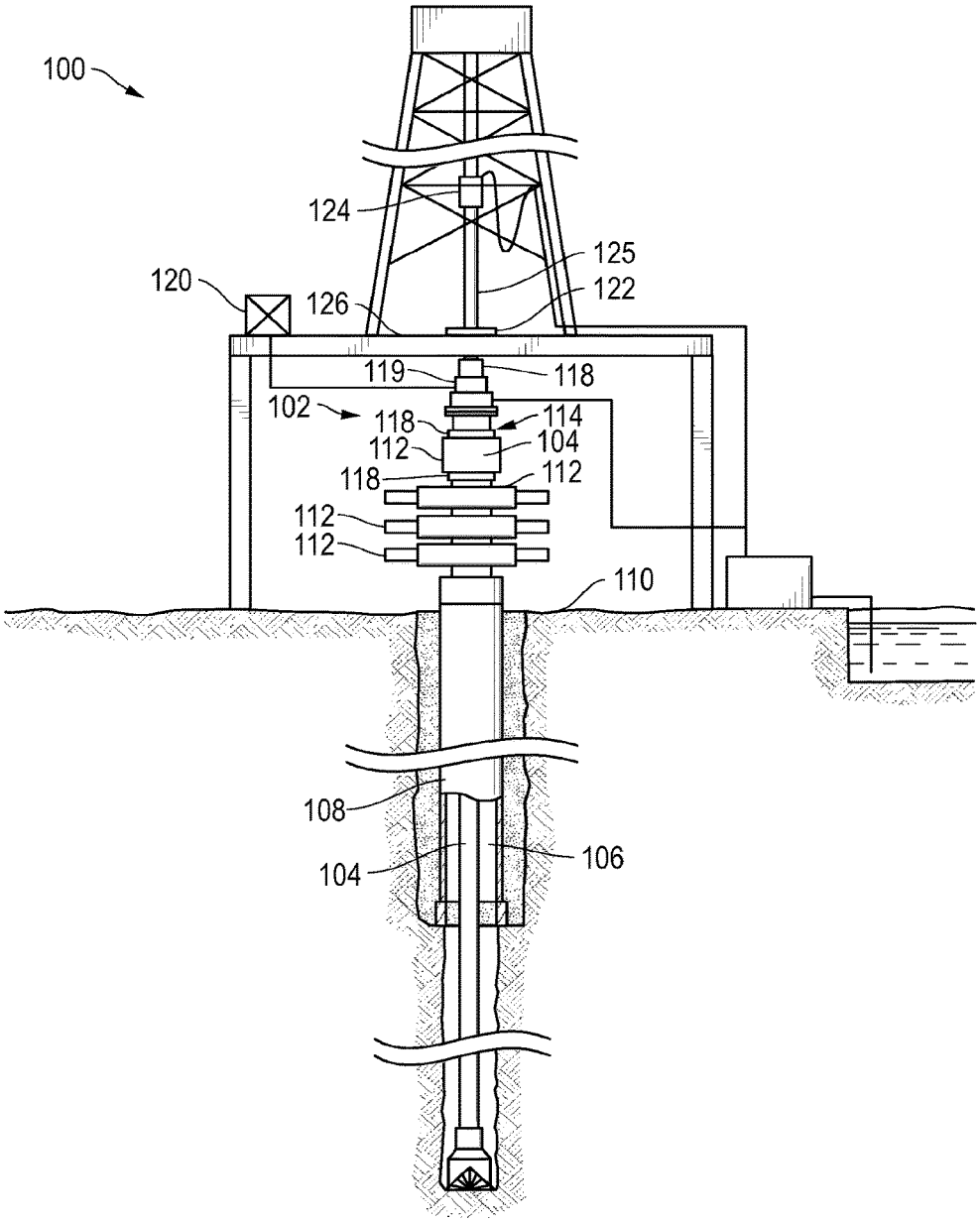
FIG. 1 depicts a schematic view of a wellsite.
Figure 1A:
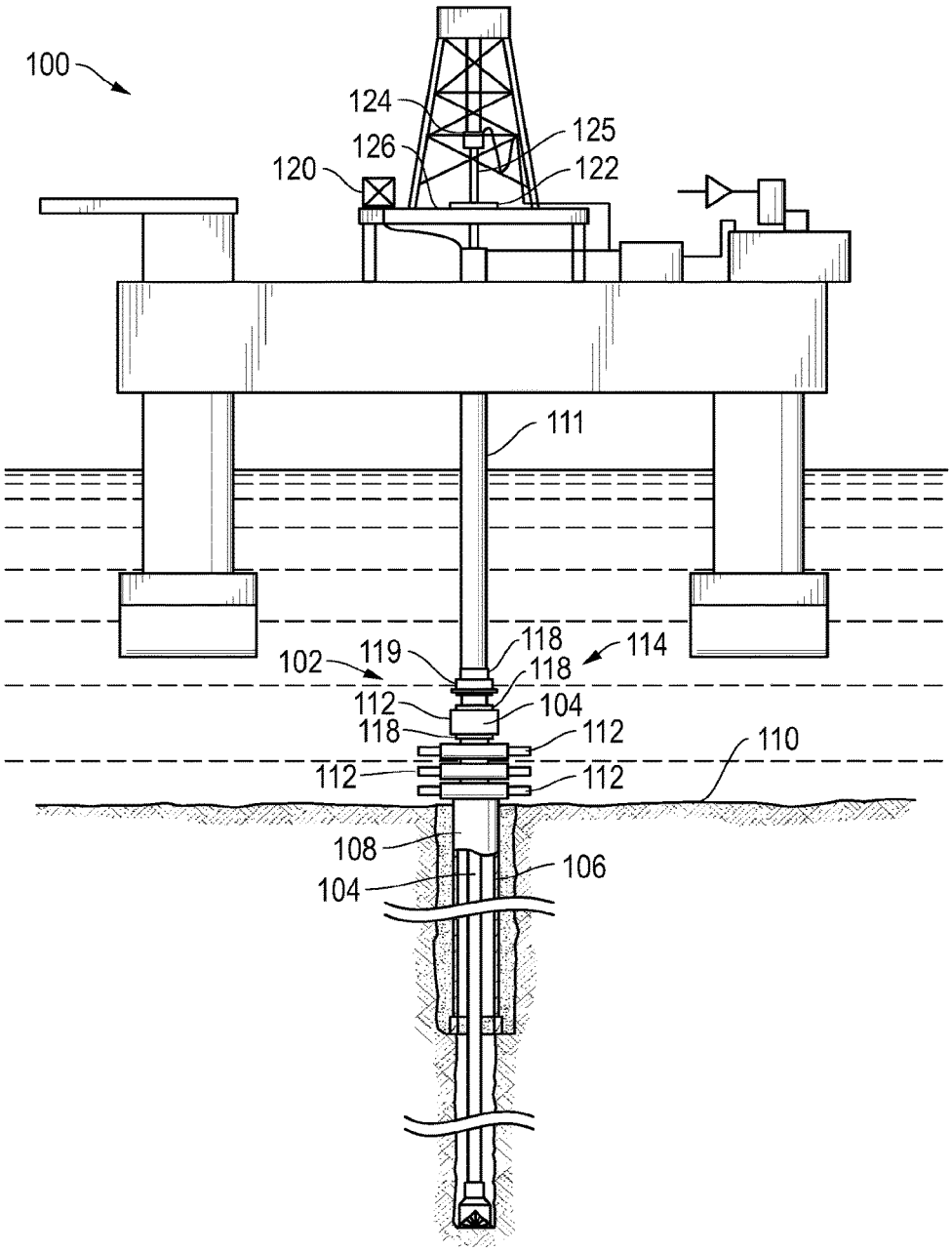
FIG. 1A depicts a schematic view of another embodiment of a wellsite.
Figure 1B:
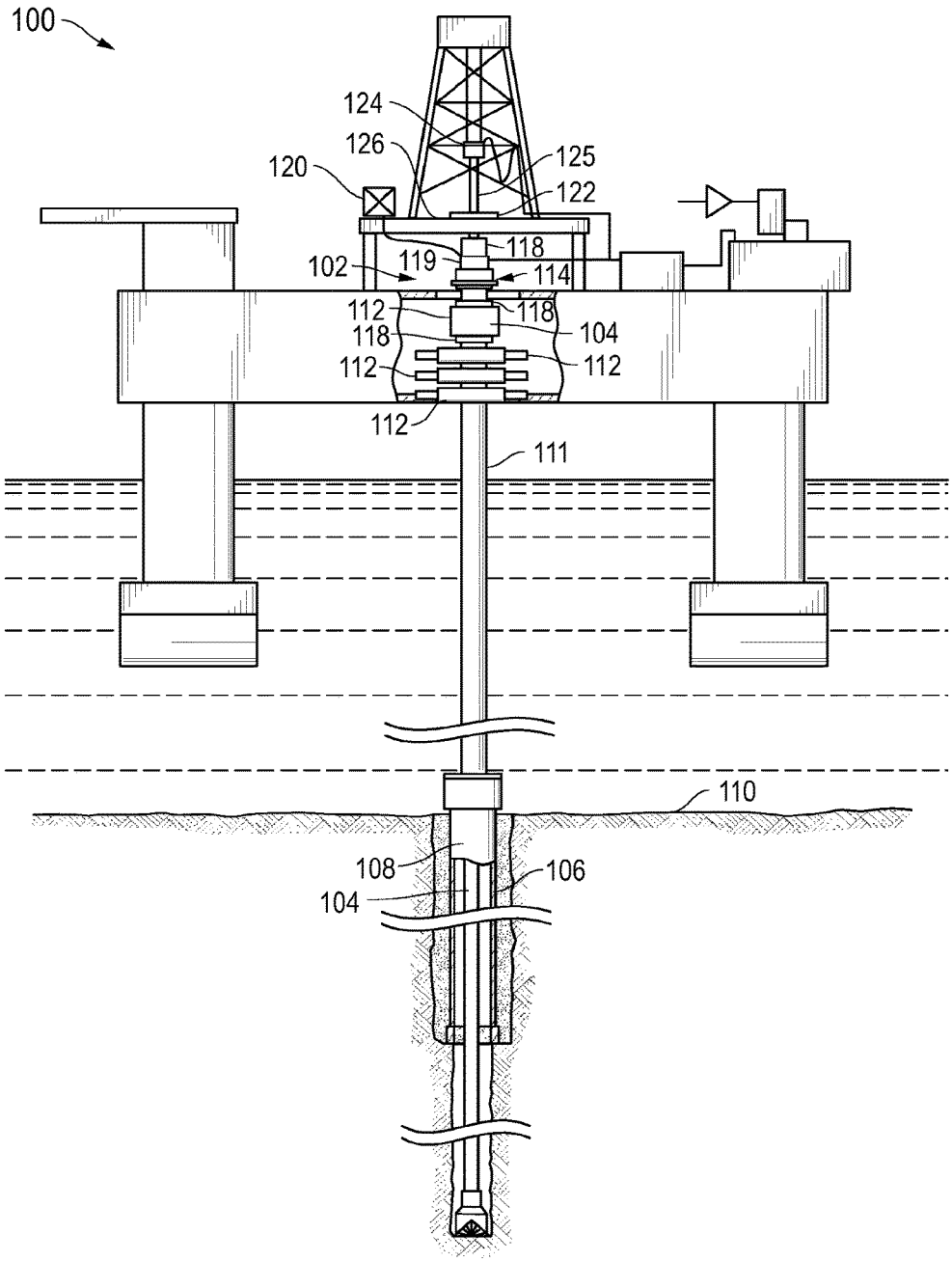
FIG. 1B depicts a schematic view of another embodiment of a wellsite.

FIGS. 1, 1A and 1B depict exemplary schematic views of a land and fixed offshore rig wellsites 100 (many applications are contemplated, and by way of example only, the disclosed embodiments are applicable to drilling rigs such as jack-up, semi-submersibles, drill ships, barge rigs, platform rigs, deepwater rigs and land rigs) having a seal 102 for sealing an item or piece of oilfield equipment 104. The wellsite 100 may have a wellbore 106 formed in the earth or seafloor 110 and lined with a casing 108. At the surface of the earth 110 (FIG. 1) or seafloor 110 (FIG. 1A), or above the riser 111 (FIG. 1B), one or more pressure control devices 112 may control pressure in the wellbore 106. The pressure control devices 112 may include, but are not limited to, BOPs, RCDs, and the like. The seal 102 is shown and described herein as being located in the RCD 114. The seal 102 may be one or more annular seals 118 located within the RCD 114. The seal 102 may be configured to engage and seal the oilfield equipment during oilfield operations. The seal 102 may have a number of variant configurations as will be discussed in more detail below. In one embodiment, the seal is a lower element, or lower seal, in a dual designed RCD 114. The oilfield equipment 104 may be any suitable equipment to be sealed by the seal 102 including, but not limited to, a bushing, a bearing, a bearing assembly, a test plug, a snubbing adaptor, a docking sleeve, a sleeve, sealing elements, a tubular, a drill pipe, a tool joint, and the like.

The seal 102 is configured for durability and may be configured to improve one or more aspects over the traditional seals used in an RCD. The seal 102 may have a particular shape, or material combination that ensures improved performance of the seal 102, as will be discussed in more detail below. The seal 102 may rotate with the oilfield equipment 104 or remain stationary while the oilfield operations are performed. The seal 102 may be configured to increase lubricity, wear resistance, chemical compatibility, and temperature tolerance in a sealing area of the RCD. The seal 102 may further be configured to increase the friction of the sealing area. The seal 102 may be suitable for an element whose primary role is to transfer torque to rotate the oilfield equipment 104, for example an inner race of the RCD. The seal 102 may have hydraulic or pneumatic power transmission with the PLC to assure oilfield equipment 104, the inner race, rotates in sync with the top drive or drill string. The seal 102 may be resistant to inverting when stripping out under high differential pressure.

The wellsite 100 may have a controller 120 for controlling the equipment about the wellsite 100. The controller 120, and/or additional controllers (not shown), may control and/or obtain information from any suitable system about the wellsite 100 including, but not limited to, the pressure control devices 112, the RCD 114, one or more sensor(s) 119, a gripping apparatus 122, a rotational apparatus 124, and the like. The gripping apparatus 122 may be a pair of slips configured to grip a tubular 125 (such as a drill string, a production string, a casing and the like) at a rig floor 126; however, the gripping apparatus 122 may be any suitable gripping device. As shown, the rotational apparatus 124 is a top drive for supporting and rotating the tubular 125, although it may be any suitable rotational device including, but not limited to, a Kelly, a pipe spinner, and the like. The controller 120 may control any suitable equipment about the wellsite 100 including, but not limited to, a draw works, a traveling block, pumps, mud control devices, cementing tools, drilling tools, and the like.

Figure 2B:
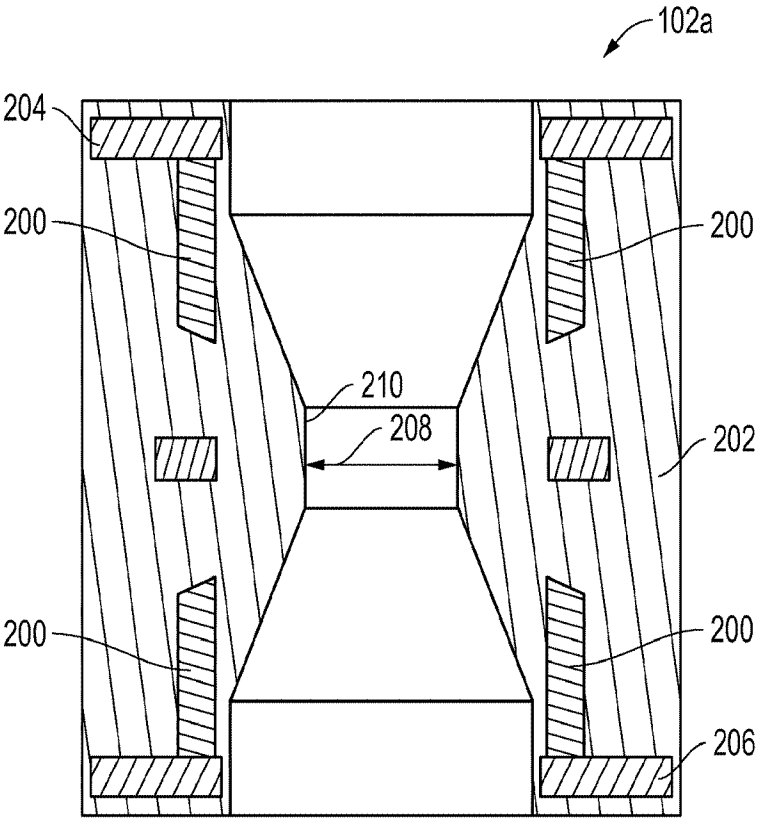
FIG. 2B depicts a cross sectional view of the seal of FIG. 2A according to an embodiment.
Figure 2A:
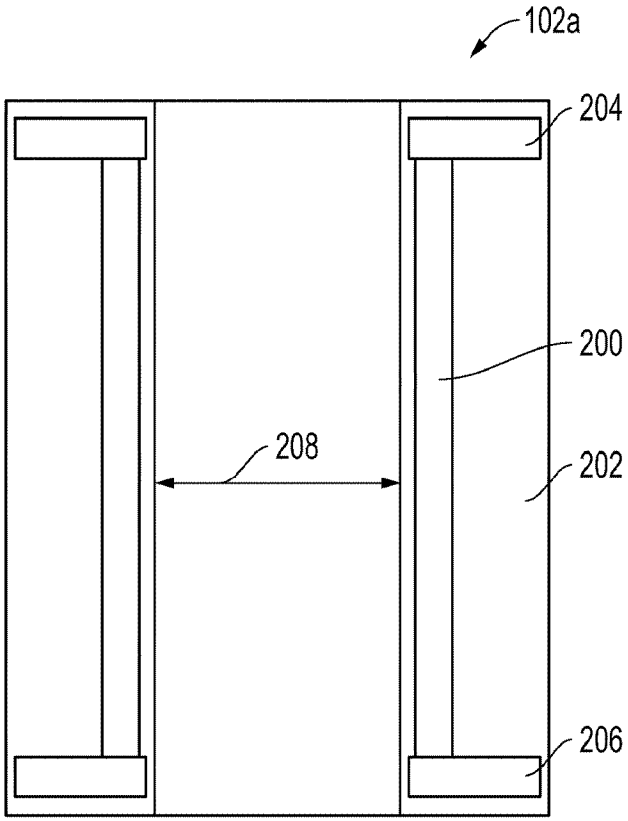
FIG. 2A depicts a cross sectional view of a seal according to an embodiment.

FIG. 2A depicts a cross sectional view of the seal 102*a* in an embodiment. The seal 102*a* may be configured to be pre-stressed by one or more springs 200 cured in a sealing material 202. The sealing material 202 may be any suitable sealing material, or combination of materials, for sealing the oilfield equipment 104 (as shown in FIG. 1) including, but not limited to, rubber, an elastomeric material, a polymer, a plastic, a ceramic, a metal any combination thereof, and the like. As shown in FIG. 2A, the seal 102*a* is in the static, or not stressed, position. The springs 200, as shown, are leaf springs coupled to a top ring 204 and a bottom ring 206. The top ring or frame 204 and bottom ring or frame 206 may be circular plates configured to support the springs 200, or have any other suitable design. Although the springs 200 are shown as leaf springs, the springs may be any suitable biasing member including but not limited to tension bars, flex bars, spring steel, reinforced composite plastic, coiled springs, and the like.

In the static position, the springs 200 may be in a vertical position, or simply the natural position of the spring 200. The sealing material 202 may then be molded around the springs 200. Initially the inner diameter 208 of the sealing material 202 may be larger than the outer diameter of the oilfield equipment 104, such as or the tool joint. The seal 102*a* may then be placed in rotational tension prior to the curing of the sealing material 202. The rotational tension may be created by rotating at least one of the top ring 204 and/or the bottom ring 206 relative to one another. The seal 102*a* is left in the rotation until the sealing material 202 cures. The rotational force may then be released.

FIG. 2B depicts a cross sectional view of the seal 102*a* after the rotational force has been released and after the sealing material 202 has cured. Releasing the rotational force may compress the sealing material 202. The compression of the sealing material 202 may force a portion of the sealing material to encroach into the inner diameter, thereby reducing the inner diameter 208 of the seal 102*a*. A sealing area 210 may be formed within the seal 102*a* that is configured to engage the oilfield equipment 104 during oilfield operations. The reduced inner diameter 208, as shown in FIG. 2B may be less than the outer diameter of the oilfield equipment 104, or tool joint. As the oilfield equipment 104 is moved through the seal 102*a*, the one or more springs 200 may allow the sealing material 202 to automatically adjust to the size of the oilfield equipment 104. The automatic adjustment may reduce wear of the sealing material 202 thereby increasing the life of the seal 102*a*. The automatic adjustment may also allow for a faster elastic recovery time of the sealing material 202.

Figure 2D:
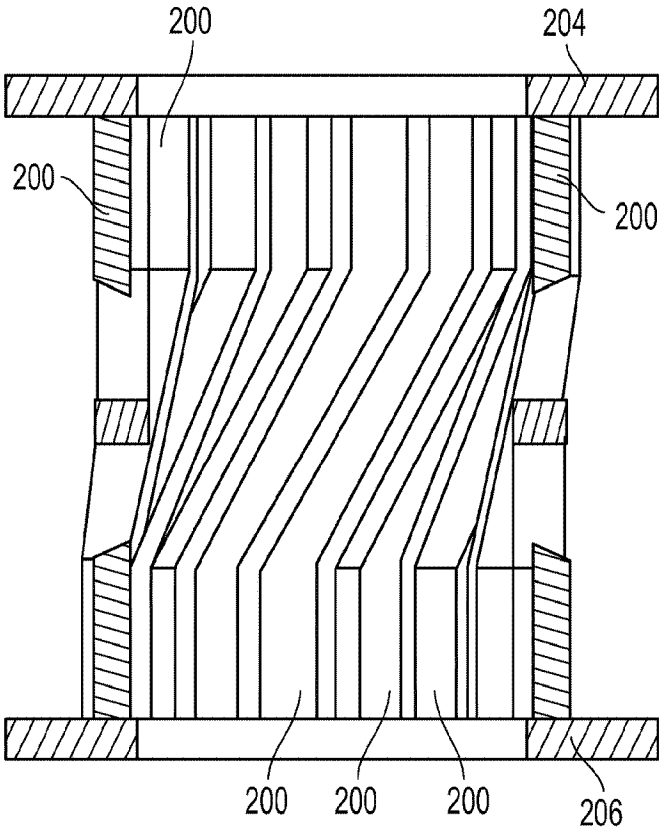
FIG. 2D depicts a cross sectional view of a portion of the seal of FIG. 2B according to an embodiment.
Figure 2C:
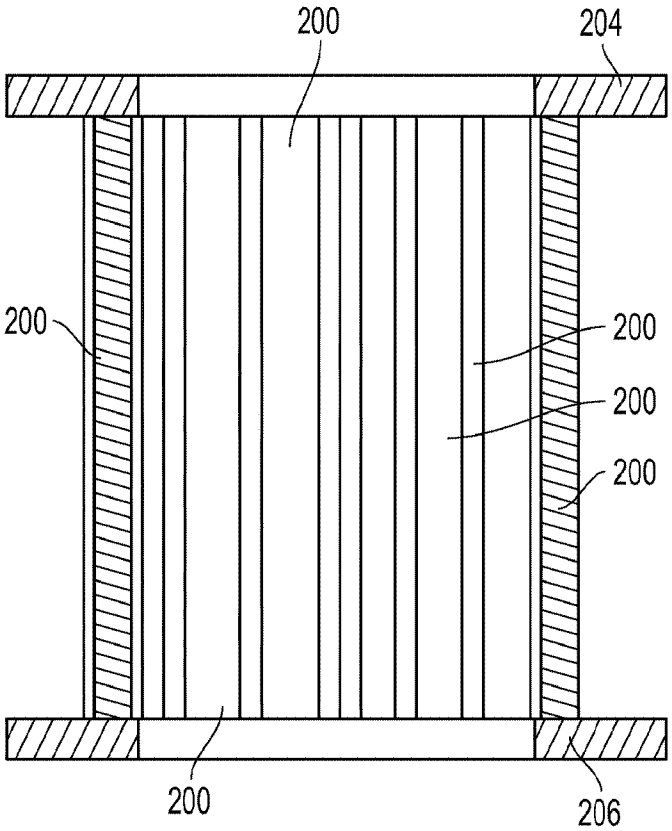
FIG. 2C depicts a cross sectional view of a portion of the seal of FIG. 2A according to an embodiment.

FIG. 2C depicts the top ring 204, the bottom ring 206, and the one or more springs 200 without the sealing material 202 in the static state. As shown there are several vertical springs 200 that couple to the rings 204 and 206. In the static state, the one or more springs 200 may be straight with no stored force in the one or more springs 200.

FIG. 2D depicts the top ring 204, the bottom ring 206, and the one or more springs 200 without the sealing material 202 in a position with the rotational tension applied to the top ring 204 and/or the bottom ring 206. As shown, the one or more springs 200 may deform and store energy within the one or more springs 200.

Figure 3:
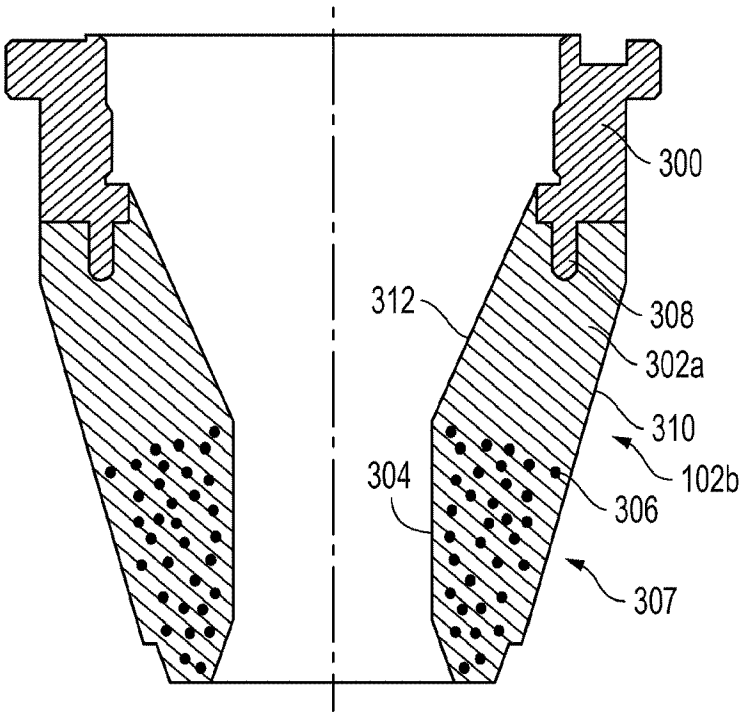
FIG. 3 depicts a cross sectional view of the seal in another embodiment.

FIG. 3 depicts the seal 102*b* in an alternative embodiment. The seal 102*b* may have a frame 300 (more commonly called a mounting ring), a seal member 302*a*, a seal surface 304 and one or more additives 306 incorporated into the seal member 302*a*. The frame 300 may be configured to couple the seal member 302*a* to a portion of the RCD 114, for example a bearing assembly (not shown). The frame 300 may be constructed of any suitable material including, but not limited to, a metal, a ceramic, a composite and the like. The frame 300 may have one or more fasteners 308 configured to couple the frame 300 to the seal member 302*a*.

The seal member 302*a* as shown has a substantially frusto-conical outer surface 310 and inner surface 312. The frusto-conical inner surface 312 may assist in guiding the oilfield equipment 104 (as shown in FIG. 1) toward the seal surface 304 during run in. The seal surface 304 may be configured to engage the outer diameter of the oilfield equipment 104. The seal member 302*a* may be made of any seal material, including those described herein. The seal member 302*a* may be molded or cast with any volume or number of the additives 306 in the seal member 302*a*.

The additives 306 may be pelletized aramid pulp in an embodiment. The additives 306 may be bonded to the seal member 302*a* using any suitable method including, but not limited to, phenolic technology, and the like. The additives may be crystalline shaped balls, or BBs, in an embodiment, although the additives 306 may have any suitable shape. In one example, but not limited to, the additives 306 may comprise two percent or less of the volume of material in the nose 307 of the seal member 302*a* in an embodiment. Further, the additives 306 may comprise any suitable amount of volume of the nose 307 of the seal member 302*a*. The additives 306 may add elasticity allowing the seal member 302*a* to elongate or stretch longer than it would without the additives 306. This may assist the seal member 302*a* in sealing the oilfield equipment 104 more flexibly thereby reducing wear of the seal member 302*a* during operations. The additives 306 may reduce the stress and strain in the seal member 302*a* during the life of the seal member 302*a*. The additives 306 may be any suitable material for reducing the strain in the seal member 302*a*. In an embodiment, the additives 306 are constructed of any of the materials found in U.S. Pat. No. 5,901,964 which is hereby incorporated by reference in its entirety.

Figure 4:
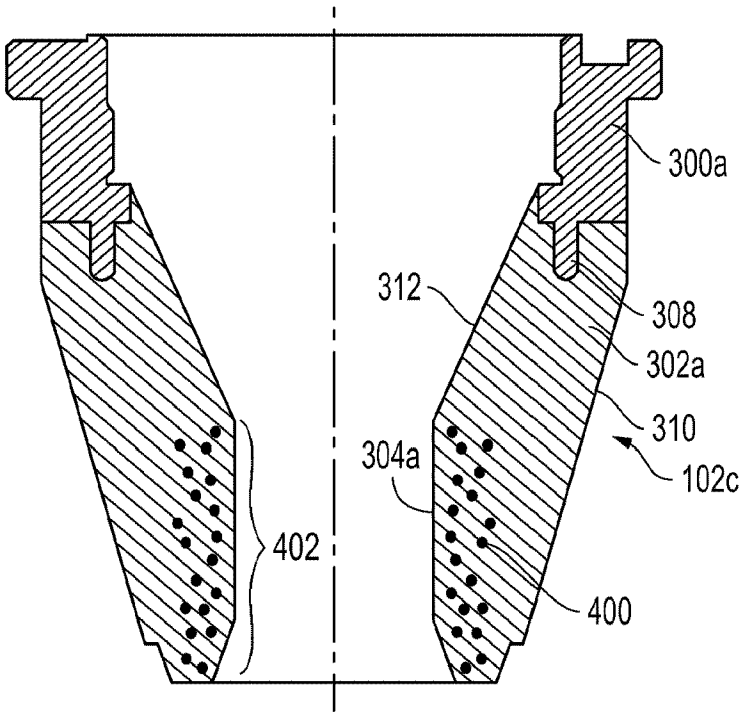
FIG. 4 depict a cross sectional view of the seal in another embodiment.

FIG. 4 depicts the seal 102*c* in an alternative embodiment. The seal 102*c* may have the frame 300*a*, the seal member 302*a*, the seal surface 304*a* similar to the seal surface 304 described in FIG. 3. The seal 102*c* may have one or more high compressive strength additives 400 molded into a specifically targeted region, which in the embodiment shown is the seal area 402, of the seal member 302*a*. The additives 400 may be molded, or bonded, into the seal member 302*a* in any suitable manner. The additives may also serve to reduce frictional heat, which is harmful to the base material of 402. The seal member 302*a* may be any suitable sealing material including those described herein. The additives 400 may be any suitable material enhancer including, but not limited to, ceramic, nylon, beryllium slivers, hydraulic fracturing proppants, and the like. The additives 400 may have any suitable shape including, but not limited to, spherical, irregular shaped, globular, crystalline BB shaped, rough surfaced BBs, and the like. The additives 400 may be configured to reduce the wear of the sealing material during operations. The additives 400 may include an additive or be made of a material for specifically targeting strength and wear enhancement of the seal member 302*a*, e.g., the additives 400 may be of a material attractive to a magnet, such as, for example, a proppant processed from bauxite or iron and aluminum hydroxides/oxides. During manufacturing, desirable regions of the mold can include a magnet or magnet field to concentrate the additives 400 immediately after the mixture is poured (into the mold) into a desired region of the seal member 302*a*.

For reference to an existing description of an additives 306 or 400 in the specific embodiments of a self-healing polymer and/or composite (capsule-based, vascular, or intrinsic), please see US patent publication number 2011/0003137 entitled "Composite Laminate with Self-Healing Layer", US patent publication number 2010/0075134 entitled "Interfacial Functionalization for Self-Healing Composites", US patent publication number 2008/0299391 entitled "Capsules, Methods for Making Capsules, and Self-Healing Composites Including the Same", EP patent publication number EP2285563 entitled "Composite Laminate with Self-Healing Layer", and U.S. Pat. No. 8,188,293 the disclosures of which are hereby incorporated by reference.

Figure 5:
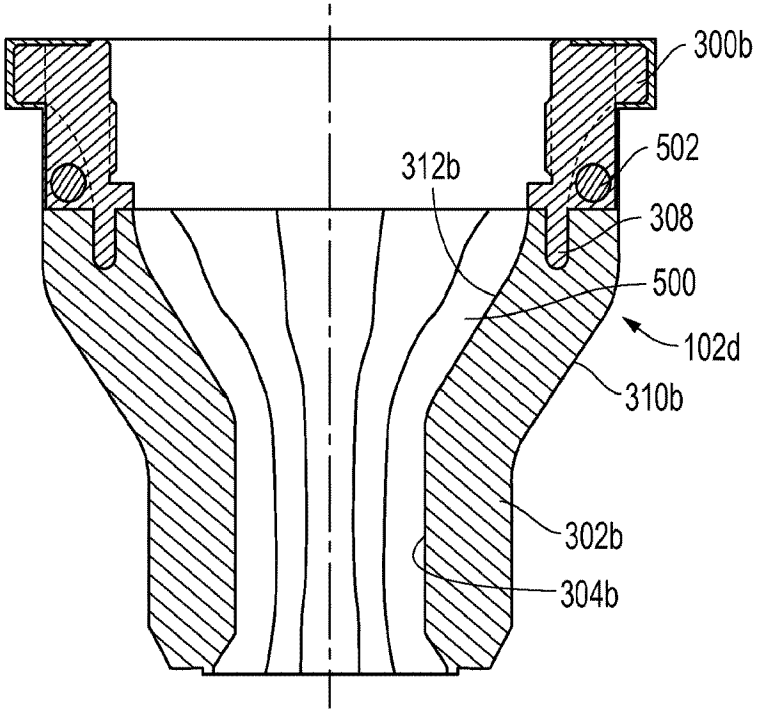
FIG. 5 depicts a cross sectional view of the seal in another embodiment.

FIG. 5 depicts the seal 102*d* in an alternative embodiment. The seal 102*d* may have a frame 300*b*, a seal member 302*b*, and an inner support frame 500, or inner skeleton. The inner skeleton 500 may be slipped over a manufacturing mandrel prior to compression molding 302*b* or pouring of a cast-able elastomer such as polyurethane. The frame 300*b* may act in a similar manner as the frame 300*a* to support the seal member 302*b* and couple it to a portion of the RCD 114 (as shown in FIG. 1). As shown, the frame 300*b* may have the fastener 308 configured to couple the frame 300*b* to the seal member 302*b*. There may be an optional tension ring 502, or O-ring, configured to secure the seal member 302*b* to the frame 300*b*. The support frame 500 may increase the rigidity of the seal member 302*b* during the life of the seal member 302*b*. The increased rigidity may prevent the seal member 302*b* from inverting during oilfield operation such as strip out. The seal member 302*b* may include the frusto-conical outer surface 310*b* and frusto-conical inner surface 312*b*. Further, the seal member 302*b* may have the seal surface 304*b* configured to engage and seal the oilfield equipment 104 (as shown in FIG. 1) during oilfield operations.

The inner support frame 500 may extend from the frame 300*b* to the seal surface 304*b* in an embodiment. In this embodiment, the inner support frame 500 may be configured to prevent the inversion of the seal member 302*b*. In another embodiment, the inner support frame 500 may extend from a location proximate the frame 300*b* to a location past the seal surface 304*b*. In this embodiment, the inner support frame 500 may be configured to prevent inversion and reduce wear of the seal member 302*b* during oilfield operations. The inner support frame 500 may be constructed of any suitable material including, but not limited to, an aramid rope, a rope, a loosely woven aramid rope that will allow for stretching of the rope as the sealing member 302*b* is stretched, a metallic material, a ceramic, a polymer, and elastic material, and the like. The inner support frame 500 may consist of vertical strands or members, spiral strands, any combination thereof, and the like.

Figure 6:
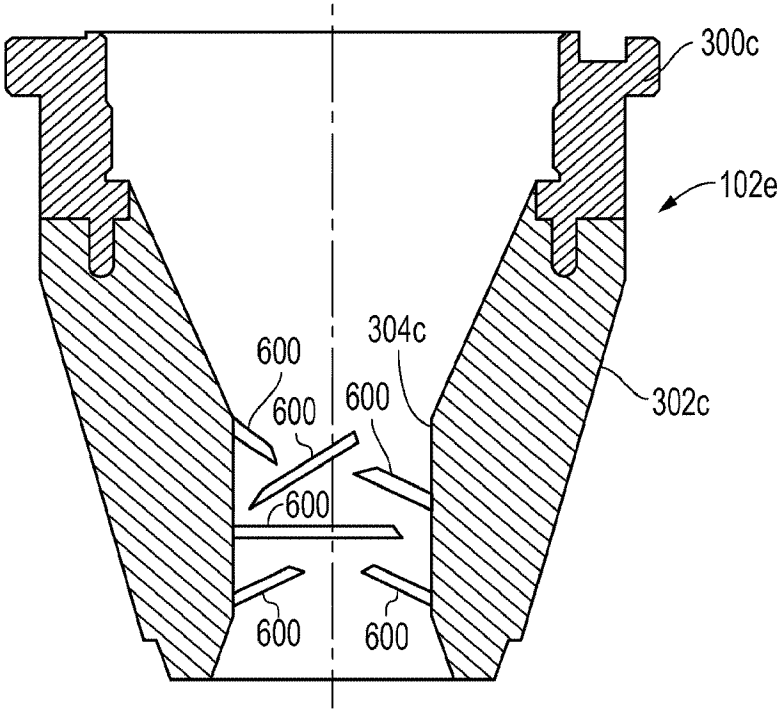
FIG. 6 depicts a cross sectional view of the seal in another embodiment.

FIG. 6 depicts the seal 102*e* in another alternative embodiment. The seal 102*e* may have the frame 300*c*, the seal member 302*c*, and one or more inserts 600 coupled to the inner surface of the seal surface 304*c*. The seal member 302*c* and the frame 300*c* may be configured in a similar manner as any of the seal members 302 and frames 300 described herein. The one or more inserts 600 may be any suitable abrasion and/or wear resistant material that are inserted into the seal surface 304*c* of the seal member 302*c*. The inserts 600 may be arranged in any suitable manner about the seal surface 304*c* so long as the inserts 600 engage the oilfield equipment 104 while the seal member 302*c* seals the oilfield equipment 104. For example, the inserts 600 may be vertical, horizontal, angled, transverse, spiral shaped, or any combination thereof.

The inserts 600 may be continuous around the seal surface 304*c*, or be discontinuous. The one or more inserts 600 may be molded into the seal member 302*c*. Once molded into the seal member 302*c*, the one or more inserts 600 may be reamed, or cut, to match the inner diameter of the seal surface 304*c*. The one or more inserts may be constructed of any suitable material including, but not limited to, a poly-aramid rope, sintered non-spark metallic (such as Al-bronze, Cu-beryllium, and the like), ceramic, metal, zirconium formulations, acetal resins, and the like. If the one or more inserts 600 are metallic, or hard, the one or more inserts 600 may be segmented in order to allow the seal surface 304*c* to conform to varying shaped oilfield equipment 104 during sealing operations. The one or more inserts 600 may be spaced apart a distance to allow the seal member 302*c* surrounding the seal surface 304*c* to allow for sufficient elongation of elastic material of the seal member 302*c* between the one or more inserts 600.

Any of the seals 102 described above, and/or below, may have a chemical application, or chemical treatment, on the seal member 302. The chemical treatment may be configured to enhance the life of the seal member 302 during oilfield operations. In an embodiment, the chemical treatment may be an application of SULFRON, a modified TWARON aramid, on the seal member 302. The SULFRON may improve the properties of sulfur- and peroxide-cured rubber compounds. The chemical treatment may reduce hysteresis, heat build-up and abrasion. The chemical treatment may improve flexibility, tear and fatigue properties.

In another embodiment, the chemical treatment is a PROAID LCF additive applied to the seal member 302. The PROAID LCF is a lubricating additive in amounts approximately 5 hundreds of the base material quantity. The PROAID LCF may bloom, activate or via rupture come to the surface of the seal member 302 when abrasions in the seal member 302 occur. This chemical treatment may be suitable for the bottom element, or seal 102, of a dual element RCD 114.

Figure 7:
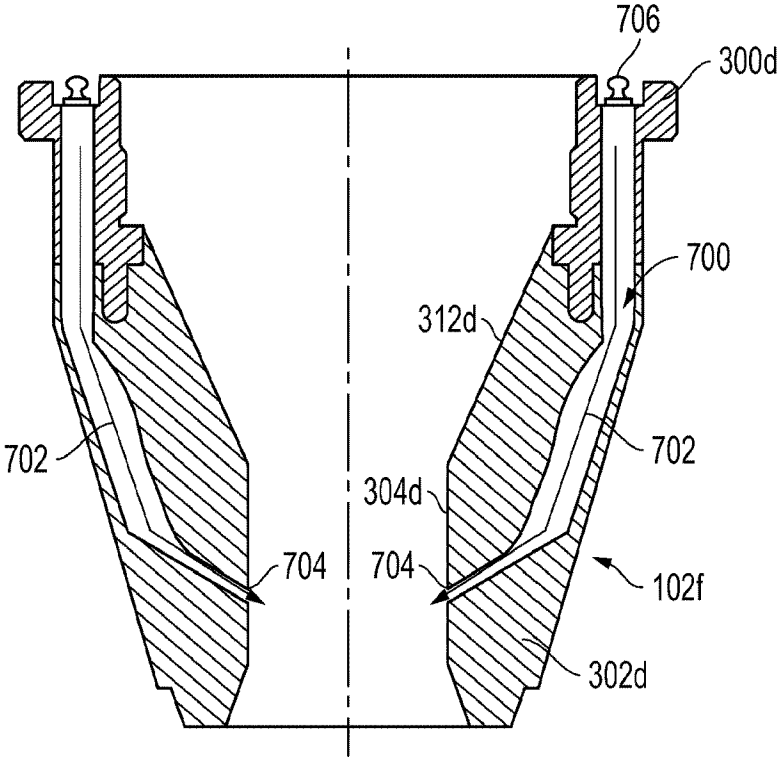
FIG. 7 depicts a cross sectional view of the seal in another embodiment.

FIG. 7 depicts the seal 102*f* in another alternative embodiment. The seal 102*f* may have the frame 300*d*, the seal member 302*d*, and a lubrication cavity 700. The frame 300*d* may be configured to couple the seal member 302*d* to the RCD 114 (as shown in FIG. 1) in a similar manner as described above. The frame 300*d* and the seal member 302*d* may have the lubrication cavity 700 through them in order to supply a volume of lubricant (depicted by arrow 702) to the seal surface 304*d*. The lubricant 702 may be any suitable lubricant for reducing friction between the seal surface 304*d* and the oilfield equipment 104 (as shown in FIG. 1) including, but not limited to, drilling fluid compatible lubricant (free of cuttings), grease, oil and the like. The lubrication cavity 700 may have one or more ports 704 for fluid communication with the seal surface 304*d*. The one or more ports 704 may have any suitable configuration (and suitable orifice diameter) including, but not limited to, spiral ports, and the like. The lubrication cavity 700 may be charged with the lubricant 702 via a grease fitting 706. The lubricant 702 may be released by any suitable method including, but not limited to, compression of the seal member 302*d*, an injection system, and the like. The injection rate of the lubricant 702 may be based on any suitable method including, but not limited to, wellbore pressure influenced injection rate, wear rate of the seal member 302*d* and the like. In the embodiments such as those shown in FIGS. 7-9, when utilizing wellbore pressure, such as embodiment may be more applicable to the lower-most seal 102 in a dual or greater stacked seal system.

Figure 8:
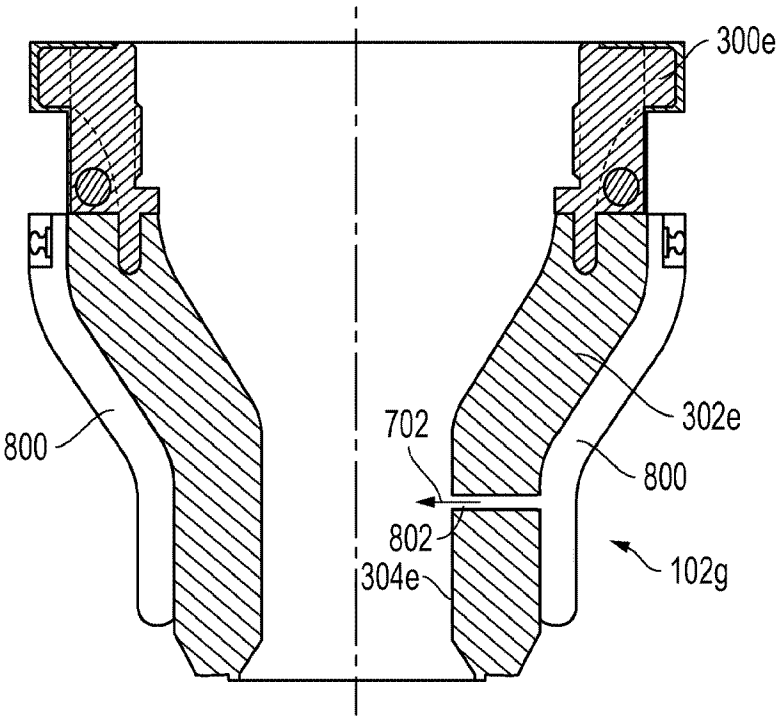
FIG. 8 depicts a cross sectional view of the seal in another embodiment.

FIG. 8 depicts the seal 102*g* in another embodiment. The seal 102*g* may have the frame 300*e*, the seal member 302*e* and an external lubricant reservoir or inflatable bladder 800. The external lubricant reservoir or inflatable bladder 800 may supply any suitable lubricant 702 to the seal surface 304*e* via one or more ports 802 in the seal member 302*e*. As shown, the external lubricant reservoir or inflatable bladder 800 is an annular reservoir surrounding the outer surface of the seal member 302*e*, although it may have any suitable configuration. The external lubricant reservoir or inflatable bladder 800 may supply the lubricant 702 to the seal surface 304*e* using any suitable method including, but not limited to, using wellbore pressure to compress the reservoir, using an accumulator, a piston, any method described herein and the like.

Figure 9:
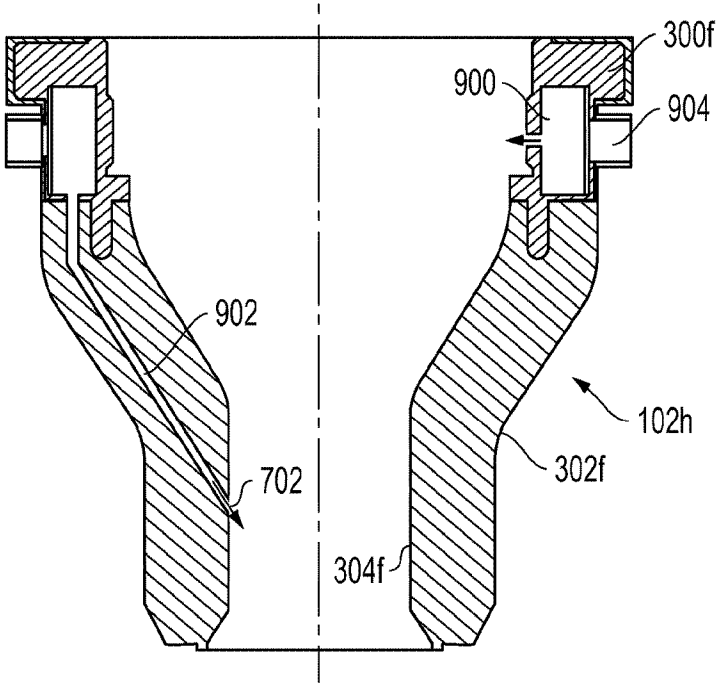
FIG. 9 depicts a cross sectional view of the seal in another embodiment.

FIG. 9 depicts the seal 102*h* in another embodiment. The seal 102*h* has the frame 300*f*, the seal member 302*f* and a lubricant reservoir 900. The lubricant reservoir 900, as shown, is located within the frame 300*f*. The lubricant reservoir 900 may supply any suitable lubricant to the seal surface 304*f* including, but not limited to, the lubricants described herein. The lubricant reservoir 900 may fluidly communicate with one or more ports 902 configured to supply the lubricant to the seal surface 304*f*. In one embodiment, a piston 904 may increase the fluid pressure in the lubricant reservoir 900 in order to supply the lubricant 702 to the seal surface 304*f*. The piston 904 may be controlled to supply the lubricant as needed in the RCD 114 (as shown in FIG. 1). Although the lubricant reservoir 900 is shown as being activated by the piston 904, any suitable device may be used to supply the lubricant 702 to the seal surface 304*f* including, but not limited to, one or more accumulators, gravity, well pressure, and the like.

Figure 10:
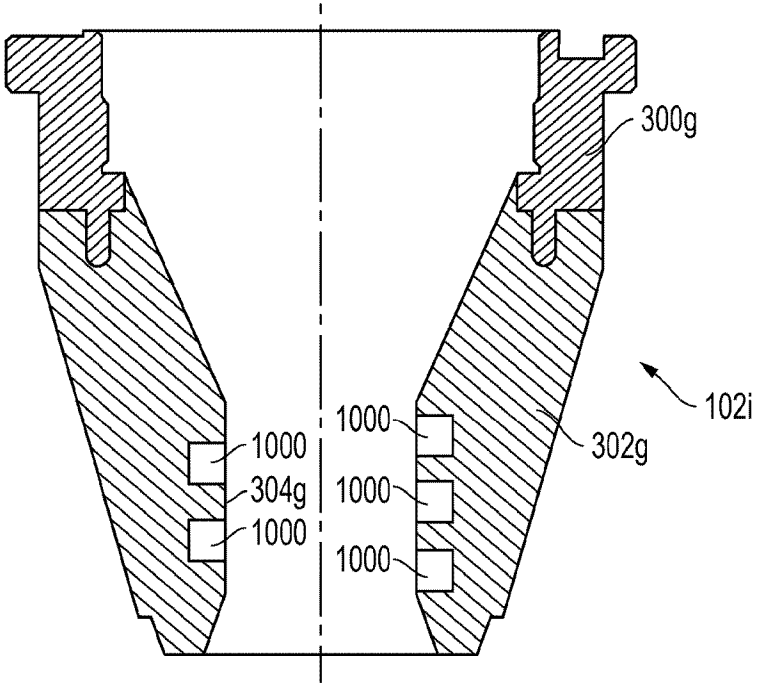
FIG. 10 depicts a cross sectional view of the seal in another embodiment.

FIG. 10 depicts the seal 102*i* in another alternative embodiment. The seal 102*i* has the frame 300*g*, the seal member 302*g*, and one or more wear buttons 1000. The one or more wear-resistant buttons 1000 may be configured to secure within the seal member 302*g* proximate the seal surface 304*g*. The one or more wear-resistant buttons 1000 may be cylindrical members molded into the seal surface 304*g* of seal member 302*g*. In an embodiment, the one or more wear-resistant buttons 1000 may have a 1.27 centimeters (0.5 inch) diameter and a 2.54 centimeters (one inch) length, however, the wear-resistant buttons 1000 may be any suitable diameter and length. The one or more wear-resistant buttons 1000 may be configured to reduce the wear on the seal member 302*g* during operations. The one or more wear-resistant buttons 1000 may be molded into the seal member 302*g* and reamed, or cut to the inner diameter of the seal surface 304*g* in a similar manner as the inserts 600 of FIG. 6. The wear-resistant buttons 1000 may be constructed of any suitable material including, but not limited to, nylon, and any of the materials described in conjunction with the one or more inserts 600, and the like. The wear-resistant buttons 1000 may be located at any suitable position on the seal surface 304*g*. For example, the wear-resistant buttons 1000 may be located along the entire length of the seal surface 304*g*, along only the lower one-third of the seal surface 304*g*, along only one-half of the seal surface 304*g*, and the like.

Figure 11:
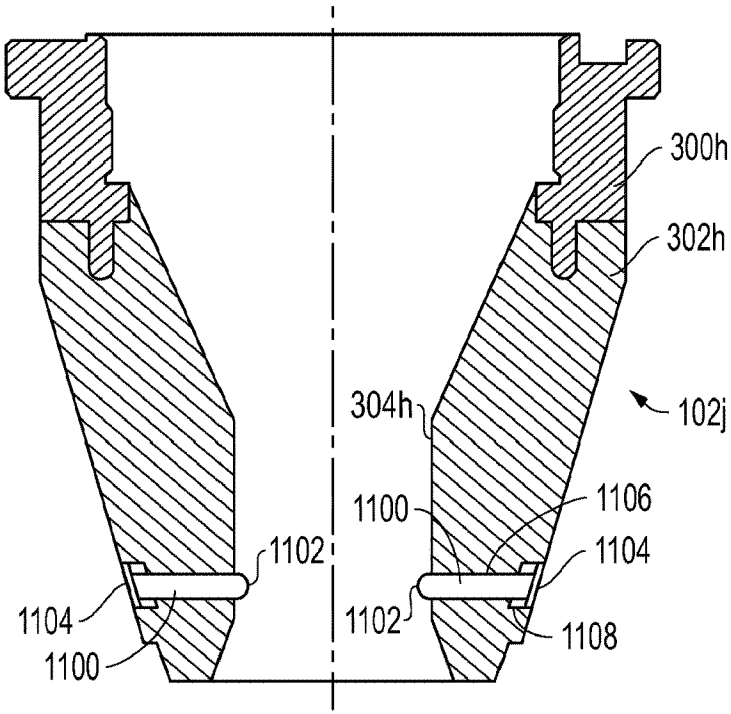
FIG. 11 depicts a cross sectional view of the seal in another embodiment.

FIG. 11 depicts the seal 102*j* in another embodiment. The seal 102*j* has the frame 300*h*, the seal member 302*h*, and one or more wear-resistant nails 1100. The one or more wear-resistant nails 1100 may be configured to penetrate the entire seal member 302*h* at a location proximate the seal surface 304*h*. As shown, the one or more wear nails 1100 penetrate the seal member 302*h* in a substantially radial or horizontal manner. A nose 1102 of each of the wear-resistant nails 1100 may be configured to engage the oilfield equipment 104 (as shown in FIG. 1) during oilfield operations. The one or more wear-resistant nails 1100 may be wear resistant and/or slick in order to reduce the stress on the seal member 302*h*. The one or more wear-resistant nails 1100 may be constructed out of any suitable material including, but not limited to, metal, ceramic, a composite, any material described herein for the inserts and/or wear buttons, and the like. The one or more wear-resistant nails 1100 may be driven into the seal member 302*h* any suitable time after the seal member 302*h* is molded.

A head 1104 of the one or more wear-resistant nails 1100 may have a larger diameter than a shaft 1106 of the wear-resistant nails 1100. For example, the head 1104 may have a one inch (2.54 centimeter) diameter, or any other suitable diameter including, greater than one inch (2.54 centimeter) or less. The seal member 302*h* may have a nail cavity 1108 proximate the head 1104 of the wear nail. The nail cavity 1108 may allow the one or more wear-resistant nails 1100 to travel radially relative to the oilfield equipment 104 during oilfield operations. The head 1104 may be exposed to wellbore pressure during oilfield operations. The wellbore pressure may supply a driving force on the head 1104 that pushes the one or more wear nails radially toward the oilfield equipment 104. Therefore, the wellbore pressure may act to force, or bias, the one or more wear nails into engagement with the oilfield equipment. The head 1104 may be angled slightly relative to the longitudinal axis of the wear-resistant nail 1100. The angle may be configured to allow the head 1104 to match the outer angle of the seal member 102*j*. The head 1104 may also have one or more notches formed in the outer diameter of the head 1104. The one or more notches may allow fluids in the nail cavity to pass therethrough as the head moves radially in the nail cavity 1108.

Figure 12:
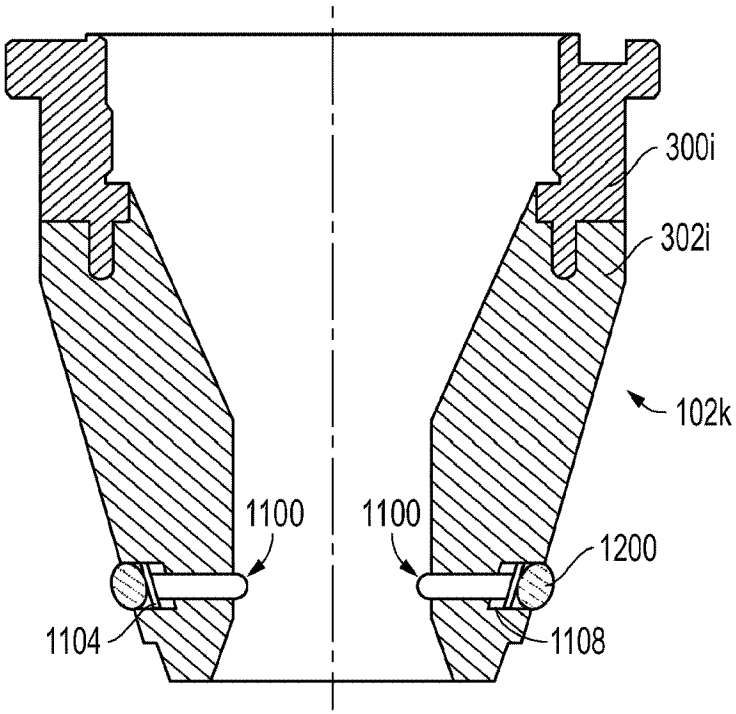
FIG. 12 depicts a cross sectional view of the seal in another embodiment.

FIG. 12 depicts the seal 102*k* in another embodiment. The seal 102*k* has the frame 300*i*, the seal member 302*i*, the one or more wear-resistant nails 1100 described above, and a tension ring 1200. The one or more wear-resistant nails 1100 may be configure in a similar manner as described herein. The tension ring 1200 may be configured engage the head 1104 of the wear-resistant nails 1100. The tension ring 1200 may apply a force on the head 1104 thereby forcing, or biasing, the wear-resistant nails 1100 radially toward the oilfield equipment 104 (as shown in FIG. 1). The tension ring 1200 having suitable outer diameter may also seal the nail cavity 1108. The tension ring 1200 may be an elastic material that is stretched slightly, or placed in tension, to be placed into engagement with the head 1104. The tension supplies the force to the head 1104. The tension ring 1200 may be made of any suitable material including but not limited to, a rubber, an elastomeric material, coil spring and the like.

Figure 13:
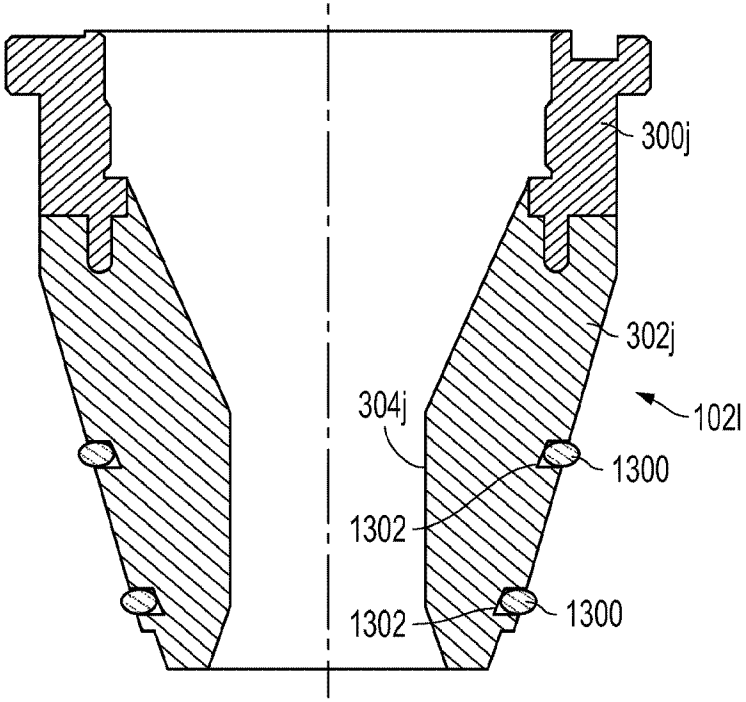
FIG. 13 depicts a cross sectional view of the seal in another embodiment.

FIG. 13 depicts the seal 102*l* in another embodiment. The seal 102*l* has the frame 300*j*, the seal member 302*j*, and one or more O-rings 1300. The one or more O-rings 1300 may be configured to be inserted into one or more annular cavities 1302 located around the outer diameter of the seal member 302*j*. The annular cavities 1302 may be any suitable width, and depth. In an example, the annular cavities 1302 may be between 1.27 centimeters (0.5 inch) and 2.54 centimeters (one inch) wide.

The O-rings 1300 may be constructed of an elastomer having four hundred to four hundred-fifty percent elongations. The O-rings may be constructed of any suitable material including, but not limited to, an elastomer, a rubber, coil spring and the like. The one or more O-rings 1300 may be stretched and placed in each of the annular cavities 1302 after the seal member 302*j* has been molded. Installed or pre-loaded, the O-rings 1300 may have about a twenty to thirty percent elongation that biases the seal member 302*j* radially toward the oilfield equipment 104 (as shown in FIG. 1). Therefore, the O-rings may force, or feed, the material on the seal surface 304*j* into the oilfield equipment 104 as the material wears away. This force on the oilfield equipment 104 may help the seal member 302*j* transfer torque to the oilfield equipment even as the seal member 302*j* wears away. Further, the O-rings 1300 may prevent splits in the seal member 302*j*, or maintain the splits in a compressed or closed position, during oilfield operations.

The seal 102*l* may only be used in dual element RCDs 114 (as shown in FIG. 1) in an embodiment. The O-rings 1300 may aggravate the inverting of the seal member 302*j* during strip out under a high differential pressure. However, in the dual element RCD 114 only the lower element is exposed to the high wellbore pressures. Therefore, the upper element may benefit more by having the embodiment of seal member 302*j* since the upper would not be exposed to the high differential pressure. Further, because the O-rings 1300 feed the seal member 302*j* into the oilfield equipment, the seal member 302*j* may wear faster than a normal seal member. In the dual element RCD 114, however, the increased wear rate of the seal 102*l* may be similar to the wear rate of the lower element.

Figure 14:
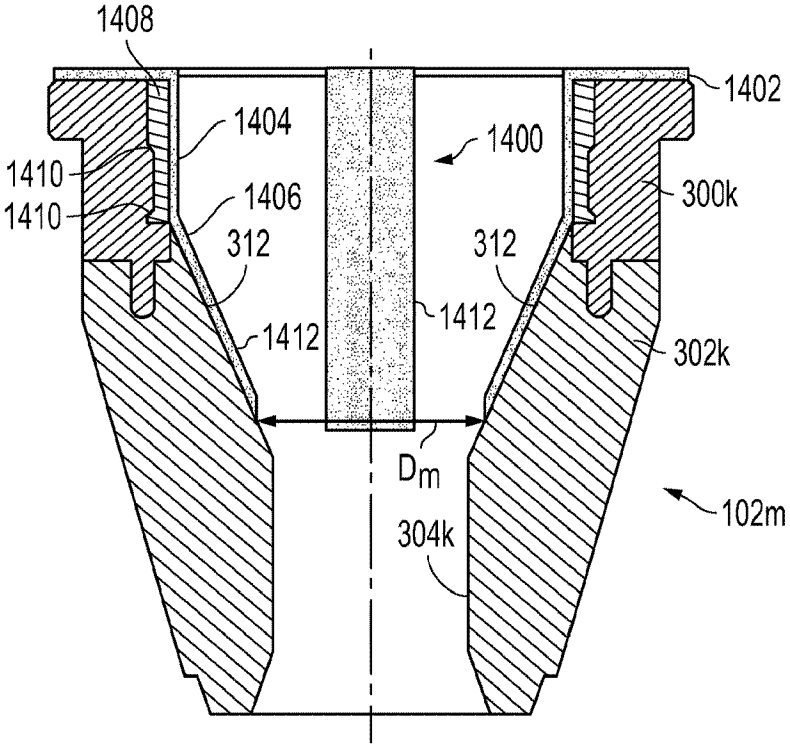
FIG. 14 depicts a cross sectional view of the seal in another embodiment.

FIG. 14 depicts the seal 102*m* in another embodiment. The seal 102*m* has the frame or mount 300*k*, the seal member 302*k*, and a backstop or support structure 1400. The support structure 1400 may be configured to prevent the seal member 302*k* from inverting during strip out of the oilfield equipment 104. The support structure 1400 may be located on the inner diameter of the seal member 302*k* in order to provide support to resist forces created by pressure, pipe movement, etc. As shown, the support structure 1400 has a top 1402, an upper seal portion 1404, a lower seal portion 1406 and a mounting ring 1408. The top 1402 may be configured to hold the support structure 1400 on the frame 300*k* of the seal 102*m* during oilfield operations. The mounting ring 1408 may couple to the support structure 1400 and to the frame 300*k*. The top 1402 may be integral with the mounting ring 1408, or the mounting ring 1408 may be held in place, or sandwiched between, frame 300*k* and the upper seal portion 1404 of the support structure 1400. As shown, the mounting ring 1408 has one or more profiles 1410 configured to engage matching profiles on the frame 300*k*. The one or more profiles 1410 may allow mounting ring 1408 and thereby the support structure 1400 to rotate relative to the frame 300*k*, while preventing relative longitudinal movement.

The upper seal portion 1404 may extend into the seal 102*m* parallel to the longitudinal axis of the seal 102*m*. The upper seal portion 1404 together with lower seal portion 1406 may be a tube, or have one or more leaves 1412, or strips, as shown. The leaves 1412 may be about 1.27 centimeters (0.5 inch) wide in an embodiment, although it should be appreciated that the leaves may be any suitable width, including, but not limited to, extending around the entire inner circumference of the seal 102*m*. The leaves 1412 may act in a manner or function similar to or as a leaf spring. Optionally the lower seal portion 1406 may extend along the inner wall of frusto-conical inner surface 312 of the seal 102*m*. The lower seal portion 1406 may have a minimum inner diameter Dm that is greater than the largest tool joint to be run into the wellbore 106 (as shown in FIG. 1). The lower seal portion 1406 may prevent the seal member 302*k* from being pulled into the inner diameter of the seal 102*m* during strip out.

Figure 14A:
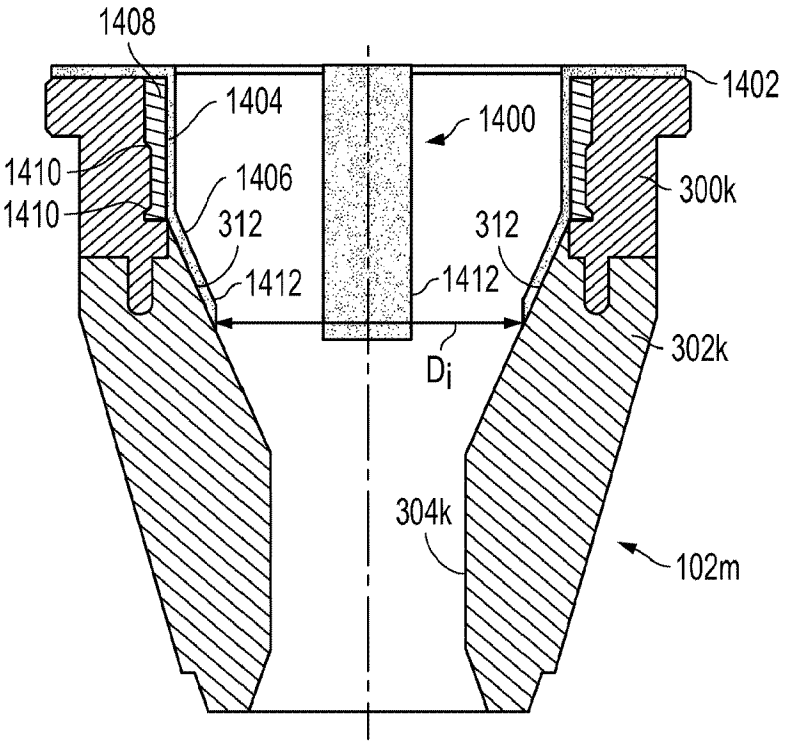
FIG. 14A depicts a cross sectional view of another embodiment of a seal similar to the embodiment of FIG. 14.

The embodiment in FIG. 14A is similar to the embodiment of FIG. 14 but diminishes the potential for contact between oilfield equipment 104 and the lower seal portion 1406 by having a shorter lower seal portion 1406 (i.e. a lower seal portion 1406 which may terminate approximately intermediate the length of the frusto-conical inner surface 312). In one embodiment the leaves 1412*a* terminate intermediate the frusto-conical inner surface 312. In FIG. 14A, the lower seal portion 1406 extends less along the inner wall of frusto-conical inner surface 312 than the embodiment in FIG. 14, thus relatively increasing the inner diameter of the support structure 1400 (relative to the minimum inner diameter Dm of the embodiment of FIG. 14) to an intermediate inner diameter Di. As the intermediate inner diameter Di is increased relative to the minimum inner diameter Dm, the oilfield equipment 104 is less likely to scrape or interfere with support structure 1400 which prolongs the lifespan of the oilfield equipment 104.

Figure 15:
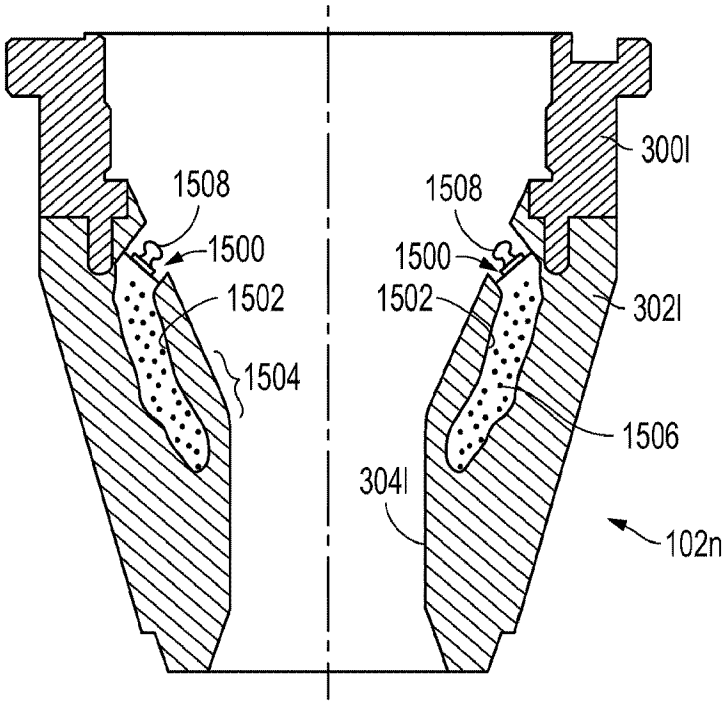
FIG. 15 depicts a cross sectional view of the seal in another embodiment.

FIG. 15 depicts the seal 102*n* in another embodiment. The seal 102*n* has the frame 300*l*, the seal member 302*l*, and one or more internal supports 1500. The internal supports 1500 may be a support, or backbone, to add stiffness to the seal member 302*l*. The increased stiffness of the seal member 302*l* may prevent inversion of the seal member 302*l* during strip out of the oilfield equipment 104. The one or more internal supports 1500 may be constructed by molding a support cavity 1502 into the seal member 302*l*. The support cavity 1502, as shown extends from a location proximate the frame 300*l* to a location proximate the seal surface 304*l* of the seal member 302*l*. The support cavity 1502 may be about 1.27 centimeters (0.5 inch) wide proximate a transition zone 1504 of the seal member 302*l*, although it should be appreciated that the support cavity 1502 may have any suitable width along the length of the support cavity 1502. The support cavity 1502 may be filled with a curing substance 1506 configured into a semi-solid such as a thermoplastic, cast-able silicone, or phenolic resin. The semi-solid may provide strength or stiffness to the seal member 302*l* against inversion. A cap or fitting 1508 may be placed on the open end of the support cavity 1502 to seal the curing substance 1506 in the support cavity 1502. In another embodiment, a port (not shown) may fluidly couple the frame 300*l* to the support cavity 1502 in order to inject the curing substance 1506 into the support cavity 1502 through the frame 300*l*. Any suitable device may be used to inject the curing substance 1506 into the support cavity 1502 including, but not limited to, a grease gun, a caulk gun, and the like.

Figure 16A:
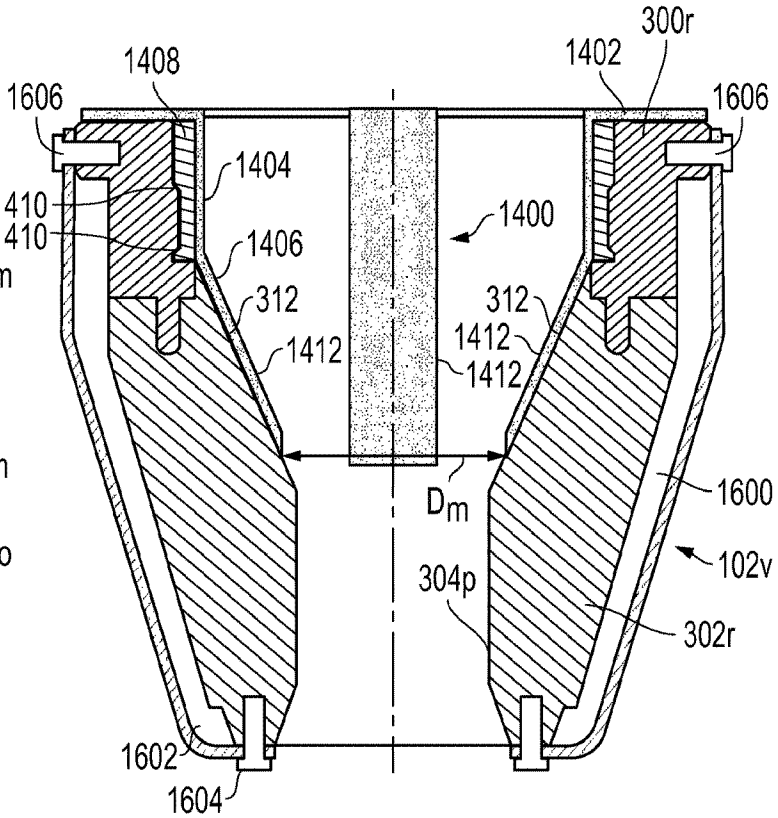
FIG. 16A depicts a cross sectional view of the seal in another embodiment.
Figure 16:
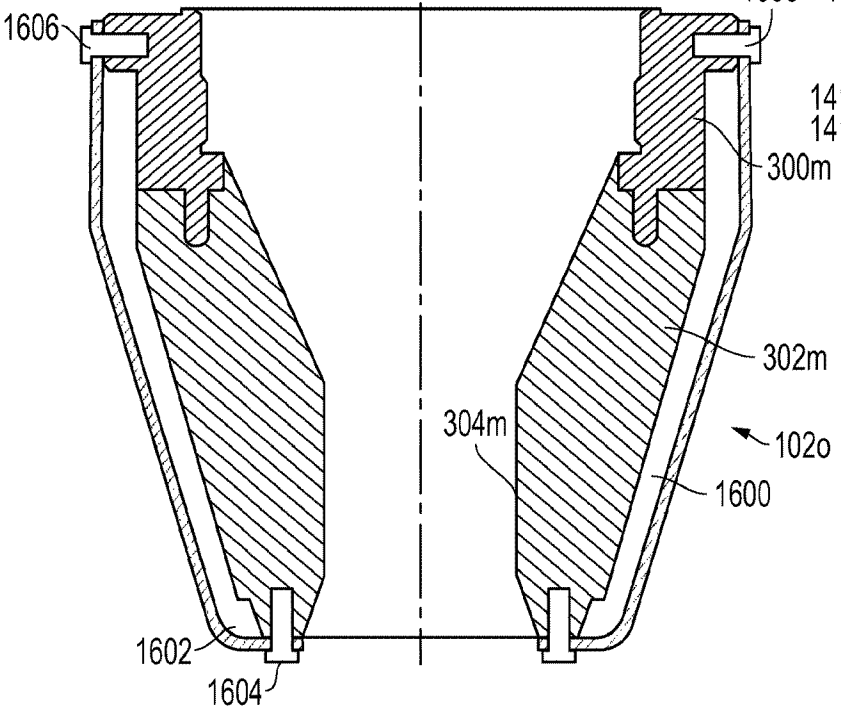
FIG. 16 depicts a cross sectional view of the seal in another embodiment.

FIG. 16 depicts the seal 102*o* in another embodiment. The seal 102*o* has the frame 300*m*, the seal member 302*m*, and one or more tension bars 1600 (by way of example only six or eight may be incorporated). The one or more tension bars 1600 add resistance to forces caused by pressure, pipe movement, etc., for example, the tension bars 1600 may prevent or inhibit the seal member 302*m* from axial movement during strip out of the oilfield equipment 104. The tension bars 1600 may be molded into or fixed to the seal member 302*m*. As shown, the lower end 1602 of the tension bars 1600 may be coupled to one another with a tension ring 1604. The tension ring 1604 may be sized to allow the largest tool joints to pass therethrough, or may be constructed of an elastic (or flexible) material that allows the tension ring 1604 to expand and contract during oilfield operations. In another embodiment the tension bars 1600 may be attached or prehensiled to the frusto-conical outer surface 310 and the frame 300*m* with fasteners 1606 (optionally including a hold-down plate/shell and with the tension ring 1604 replaced by fasteners 1606).

The tension bars 1600 may extend from the nose of the seal member 302*m* to the frame 300*m*. As shown, the tension bars 1600 are coupled to the frame 300*m* with one or more fasteners 1606. The one or more tension bars 1600 may be constructed of any suitable material including, but not limited to, a metal, a ceramic, any materials described herein, and the like. The one or more tension bars 1600 may flex during oilfield operations in order to accommodate the elongation of the seal member 302*m*. The one or more tension bars 1600 may be tied, or wire tied, together to prevent the tension bars 1600 from falling into the wellbore 106 (as shown in FIG. 1).

FIG. 16A depicts seal 102*v* in another embodiment, in which the features of the embodiments shown in FIG. 14 and FIG. 16 are combined. The seal 102*v* has the frame 300*r*, the seal member 302*r*, seal surfaces 304*p*, a support structure 1400, and one or more tension bars 1600 (by way of example only six or eight may be incorporated). The one or more tension bars 1600 may prevent the seal member 302*r* from inverting during strip out of the oilfield equipment 104. The tension bars 1600 may be molded into or fixed to the seal member 302*r*. As shown, the lower end 1602 of the tension bars 1600 may be coupled to one another with a tension ring 1604. The tension ring 1604 may be sized to allow the largest tool joints to pass therethrough, or may be constructed of an elastic (or flexible) material that allows the tension ring 1604 to expand and contract during oilfield operations. In another embodiment the tension bars 1600 may be attached or prehensiled to the frusto-conical outer surface 310 and the frame 300*m* with fasteners 1606 (optionally including a hold-down plate/shell and with the tension ring 1604 replaced by fasteners 1606).

The tension bars 1600 may extend from the nose of the seal member 302*r* to the frame 300*r*. As shown, the tension bars 1600 are coupled to the frame 300*r* with one or more fasteners 1606. The one or more tension bars 1600 may be constructed of any suitable material including, but not limited to, a metal, a ceramic, any materials described herein, and the like. The one or more tension bars 1600 may flex during oilfield operations in order to accommodate the elongation of the seal member 302*r*. The one or more tension bars 1600 may be tied, or wire tied, together to prevent the tension bars 1600 from falling into the wellbore 106 (as shown in FIG. 1).

The support structure 1400 in FIG. 16A may be configured to prevent the seal member 302*r* from inverting during strip out of the oilfield equipment 104. The support structure 1400 may be located on the inner diameter of the seal member 302*r* in order to prevent inversion. As shown, the support structure 1400 has a top 1402, an upper seal portion 1404, a lower seal portion 1406 and a mounting ring 1408. The top 1402 may be configured to hold the support structure 1400 on the frame 300*r* of the seal 102*v* during oilfield operations. The mounting ring 1408 may couple to the support structure 1400 and to the frame 300*r*. The top 1402 may be integral with the mounting ring 1408, or the mounting ring 1408 may be held in place, or sandwiched between, frame 300*r* and the upper seal portion 1404 of the support structure 1400. As shown, the mounting ring 1408 has one or more profiles 1410 configured to engage matching profiles on the frame 300*r*. The one or more profiles 1410 may allow mounting ring 1408 and thereby the support structure 1400 to rotate relative to the frame 300*r*, while preventing relative longitudinal movement.

The upper seal portion 1404 may extend into the seal 102*v* parallel to the longitudinal axis of the seal 102*v*. The upper seal portion 1404 together with lower seal portion 1406 may be a tube, or have one or more leaves 1412, or strips, as shown. The leaves 1412 may be about 1.27 centimeters (0.5 inch) wide in an embodiment, although it should be appreciated that the leaves 1412 may be any suitable width, including, but not limited to, extending around the entire inner circumference of the seal 102*v*. The leaves 1412 may act in a similar manner as a leaf spring. Optionally the lower seal portion 1406 may extend along the inner wall of frusto-conical inner surface 312 of the seal 102*v*. The lower seal portion 1406 may have a minimum inner diameter Dm (or as represented in the embodiment of FIG. 14A an intermediate diameter) that is greater than the largest tool joint to be run into the wellbore 106 (as shown in FIG. 1). The lower seal portion 1406 may prevent the seal member 302*r* from being pulled into the inner diameter of the seal 102*v* during strip out.

Figure 17B:
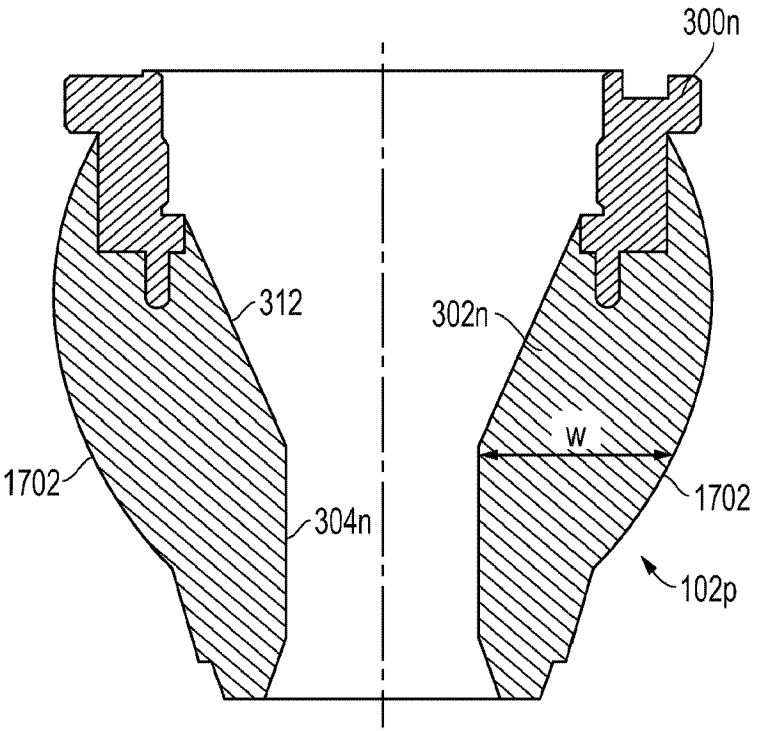
FIG. 17B depicts a cross sectional view of the seal in the embodiment of FIG. 17A.
Figure 17A:
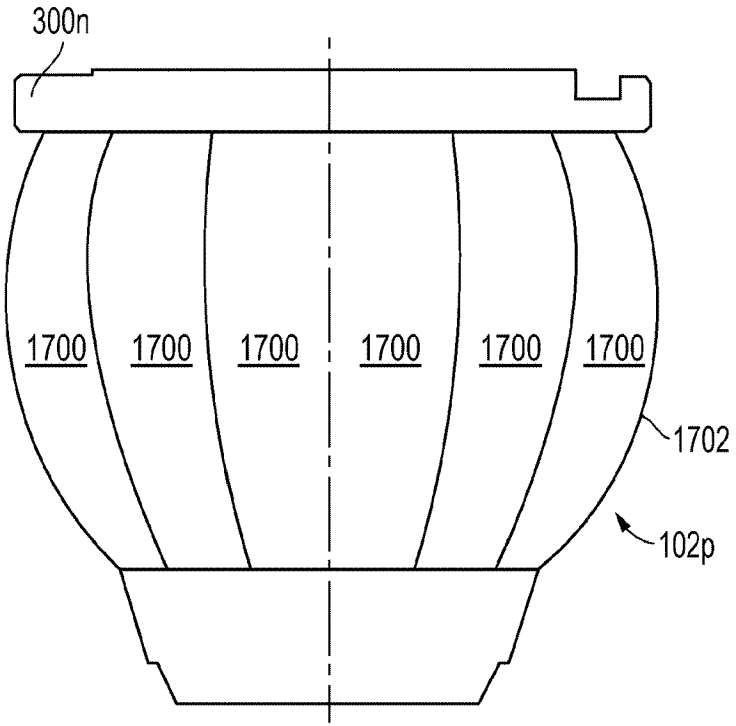
FIG. 17A depicts a side view of the seal in another embodiment.

FIG. 17A depicts a side view of the seal 102*p* in another embodiment. FIG. 17B depicts a cross-sectional view of the seal 102*p* in this embodiment. The seal 102*p* may have the frame 300*n* similar to any of the frames 300 described herein. The seal member 302*n* of the seal 102*p* may have a plurality of seal segments 1700. The seal segments 1700 may bulge outward along their outer surface 1702. The bulging outer surface 1702 may give the outer surface an appearance similar to a pumpkin. As shown in FIG. 17B the bulges may start at a location on the outer surface of the seal member 302*n* proximate the seal surface 304*n*. In an example, the bulges start about half way up the seal surface 304*n*. The bulges may be formed by molding, or by compressing the molding before curing is complete, or a combination thereof. By compressing the seal member 302*n* to form the bulges the seal member 302*n* may have a pre-stress to push downward. The bulges may become progressively more pronounced up the outer surface 1702 toward the frame 300*n*. The increased cross-sectional area of the seal member 302*n* provided by the bulges may prevent inverting of the seal member 302*n* and decreased vector forces (caused by wellbore pressure and "decreased" as discussed here in context is relative to the wellbore vector forces experienced by, for example, frusto-conical surface 310 of the embodiment of FIG. 3) on the seal surface 304*n* thereby decreasing wear on the seal member. The bulges may flatten upon stripping out rather than inverting due to the increased cross-sectional area. The wall thickness or width W of the bulges may be adjusted in order to decrease the likelihood of inversion.

The seal member 302*n* may be in tension when engaged with the oilfield equipment 104 (as shown in FIG. 1). For example, the seal member 302 may have a stretch fit tightness around the oilfield equipment 104. The bulges in the seal segments 1700 may allow the seal member 302*n* to expand as the tool joints pass through the seal member 302*n*.

The seal member 302*n*, or any other seal members 302 described herein, may have one or more abrasion resistant bars molded into the seal member 302*n*. The abrasion resistant bars may be made of any suitable material including, but not limited to, nylon, and the like. The abrasion resistant bars may assist in forming the bulges on each of the seal segments 1700.

Figure 18:
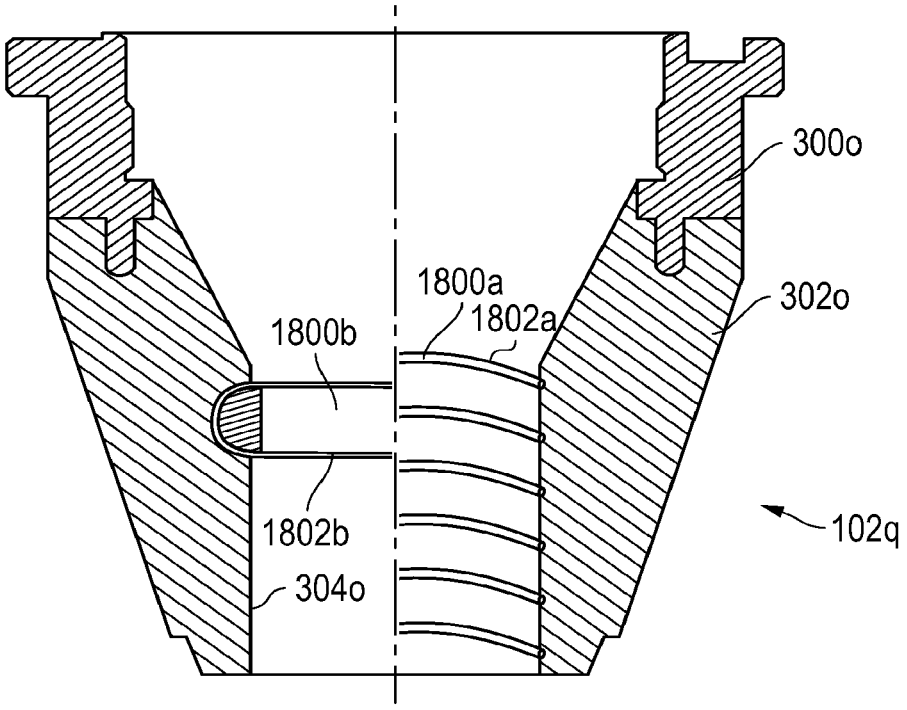
FIG. 18 depicts a cross sectional view of the seal in another embodiment.

FIG. 18 depicts a cross-sectional view of the seal 102*q* in another embodiment. The seal 102*q* has the frame 300*o*, the seal member 302*o*, and one or more sealing inserts 1800. As shown, the sealing inserts 1800 may be a threaded sealing insert 1800*a*, or an annular sealing insert 1800*b*. The sealing inserts 1800 may be located in a seal profile 1802 molded into the inner wall of the seal surface 304*o*. The threaded sealing insert 1800*a* may be threaded into seal profile 1802*a* of the seal surface 304*o* in order to fix the seal insert 1800*a* into the seal member 302*o*. The annular seal insert 1800*b* may be forced into the seal profile 1802*b*. The annular seal insert 1800*b* and/or seal profile 1802*b* may have a J-latch, or other shaped latch to fix the seal insert 1800*b* into the seal profile 1802*b*. Although the seal inserts 1800 are described as being threaded or annular, it should be appreciated that the seal inserts 1800 may be any suitable shape so long as the seal inserts 1800 seal the inner circumference of the seal surface 304*o*.

The seal inserts 1800 may be configured to engage the oilfield equipment 104 (as shown in FIG. 1) during oilfield operations. The seal inserts may be 1.27 centimeters (0.5 inch) to 2.54 centimeters (one inch) thick in an embodiment, although any suitable thickness may be used. Therefore, the seal inserts 1800 may extend radially inward beyond the inner diameter of the seal surface 304*o*. In this embodiment, only the seal inserts 1800 wear during oilfield operations. Therefore, only the seal inserts 1800 need to be replaced during the life of the seal 102*q* and the seal member 302*o* is reusable. The seal inserts 1800 may push the outer circumference of the seal member 302*o* near the nose end out when compared to the standard seal element.

The material of the seal inserts 1800 may be configured to meet the needs of the particular oilfield operations being conducted. For example, the seal inserts 1800 may have material properties optimized for sealing the oilfield equipment 104. Because only the seal inserts 1800 engage the oilfield equipment 104, the material of the seal inserts 1800 may be a more costly and efficient material, while using any suitable material on the seal member 302*o* and other equipment. Because the wall thickness of the shell in the nose area of the seal member 302*o* holding the seal insert 1800 is less, additives that would otherwise make the seal member 302*o* too hard to stab may be allowed throughout the seal member 302*o*. The additives may include, but are not limited to, HIPERSTRIP and the like, and may be constructed of any of the materials found in U.S. Pat. No. 5,901,964 which is hereby incorporated by reference in its entirety.

In another embodiment, in a dual element RCD 114, the material of seal inserts 1800 may vary between each element depending on the operations being performed. For example, a wear resistant material may be used for seal inserts 1800 in the top element and a lubricating material may be used in the seal inserts 1800 in the bottom element to reduce heat generation from taking the brunt of differential pressure.

The seal inserts 1800 may vary in size depending on the size of the oilfield equipment 104. Therefore the seal inserts 1800 may be replaced when a larger or smaller sized drill pipe is being run through the RCD 114. In an embodiment, the seal inserts 1800 may be replaced without having to remove the whole seal member 302*o* from the inner race of the bearing assembly. Further, the same size seal member 302*o* may be used for a number of different sized pieces of oilfield equipment 104 (for example pipe sizes). Therefore, the same seal member 302*o* may be used for a number of different pipe sizes for a particular RCD model.

Figure 19B:
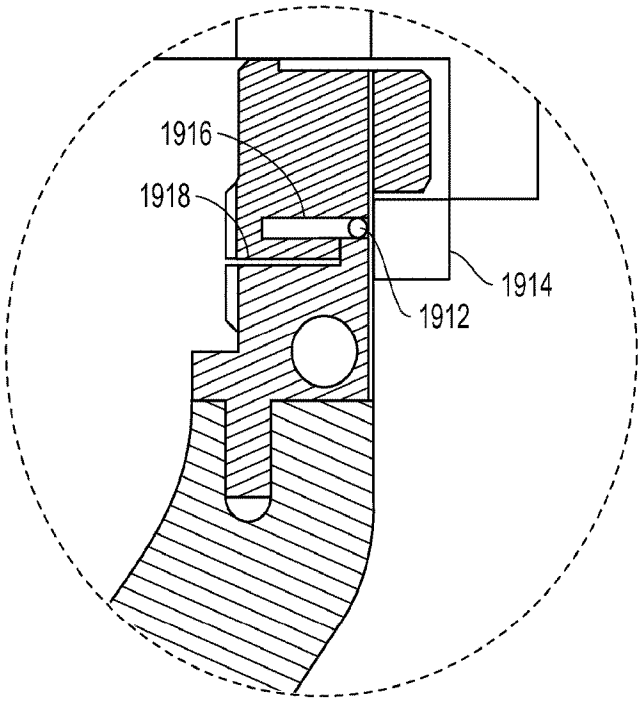
FIG. 19B depicts a cross sectional view a portion of the seal in the embodiment of FIG. 19A.
Figure 19A:
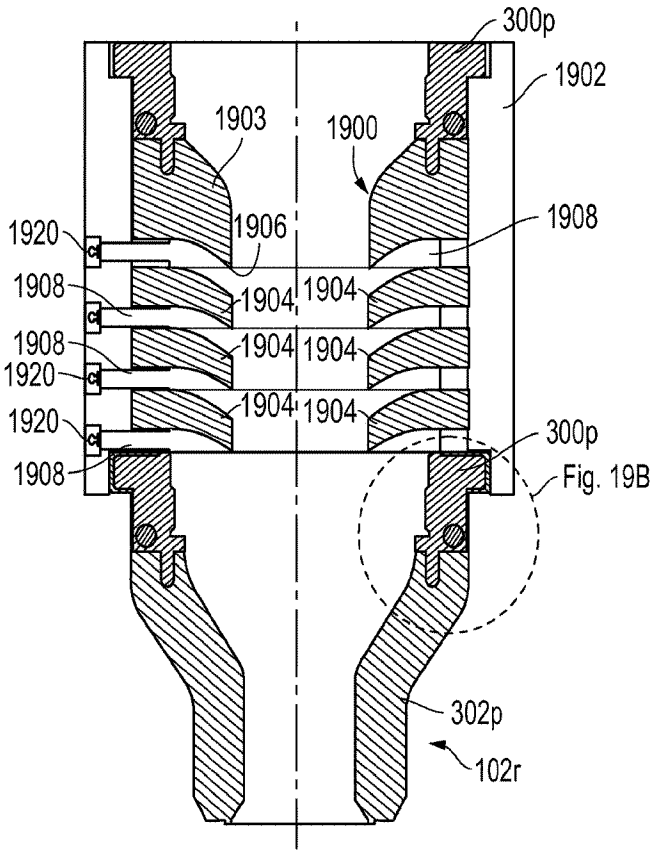
FIG. 19A depicts a cross sectional view of the seal in another embodiment.

FIG. 19A depicts a cross-sectional view of the seal 102*r* in another embodiment. The seal 102*r* may have the frame 300*p*, and the seal members 302*p* similar to any of the frames 300 and seal members 302 described herein. The seal 102*r* may also have a plurality of seal surfaces 1900 contained in a cartridge 1902. The cartridge 1902 may be a tube for containing the seal surfaces 1900. The cartridge 1902 may be made of any suitable material including, but not limited to, a metal, a reinforced thermoplastic, a ceramic, a composite, and the like. The cartridge 1902 may be any suitable length for containing the plurality of seal surfaces 1900 including, but not limited to, 1.22 meters (four feet) long, less than 1.22 meters (four feet) long, or greater than 1.22 meters (four feet) long.

The plurality of seal surfaces 1900 may be fixed to the cartridge 1902. The upper most seal surface 1900 may be a shaped seal member 1903. The shaped seal member 1903 may be located above the lower seal surfaces 1900. The lower seal surfaces 1900 may comprise one or more packers 1904. The shaped seal member 1903 may be similar to any of the seal members 302 described herein. However, the shaped seal member 1903 may have a shaped nose 1906 configured to match the shape of the packers 1904 thereby creating an annular space 1908 between the shaped seal member 1903 and the uppermost packer 1904. The shaped seal member 1903 may be suitable for transmitting torque to the oilfield equipment 104 (as shown in FIG. 1). The differential pressure between the one or more packers 1904 and the shaped seal member 1903 may be controlled in order to reduce wear and tear on the seal surfaces 1900. The inner-most ends of the packers 1904 may be angled for optimal intersection characteristics with the oilfield equipment 104.

The differential pressure between the packers 1904 and/or the shaped seal member 1903 may be controlled using any suitable method. For example, after the oilfield equipment 104 is stabbed into the seal 102*r*, the annular space 1908 may be grease packed with a grease gun. The pressure in the wellbore 106, and/or the differential pressure sharing in the drill string may control the differential pressure between the annular spaces 1908. Further, the rotation of the seal 102*r* and/or the differential pressure sharing with the drill string may control the pressure in the annular spaces 1908. A fitting 1920 may be located at the end of each of the annular spaces 1908 in order to fill the annular spaces 1908 with grease and/or another fluid.

FIG. 19B depicts a detail of the lower frame 300*p* and lower seal member 302*p* of the embodiment of FIG. 19B for controlling the differential pressure between annular spaces 1908. Wear and tear may be reduced by controlling differential pressure. A valve 1912 may be installed proximate the lower frame 302*p*. The valve 1912 may be any suitable valve including, but not limited to, a check valve, a one-way valve, a relief valve and the like. A spring 1916 may be designed to allow valve 1912 to open at some preset pressure (e.g. three hundred psi). An optional filter 1914 may be used to prevent annulus returns debris from entering the seal 102*r*. When valve 1912 opens returns can enter above the lower frame 300*p* via a relief port 1918. In another embodiment, the valve 1912 may be replaced by varying sized orifices, or ports to control the pressure between each of the packers 1904. The valve(s) 1912, and/or the orifices, may be sized to approximate differential pressure sharing in the annular spaces 1908. In an additional embodiment, there may be one or more valves 1912, and/or orifices, formed through the packers 1904 in order to fluidly communicate between the annular spaces 1908. In yet another embodiment, the one or more valves 1912, or orifices may be locate through the wall of the cartridge 1902 in order expose the annular space 1908 to the wellbore 106 pressure.

Figure 20A:
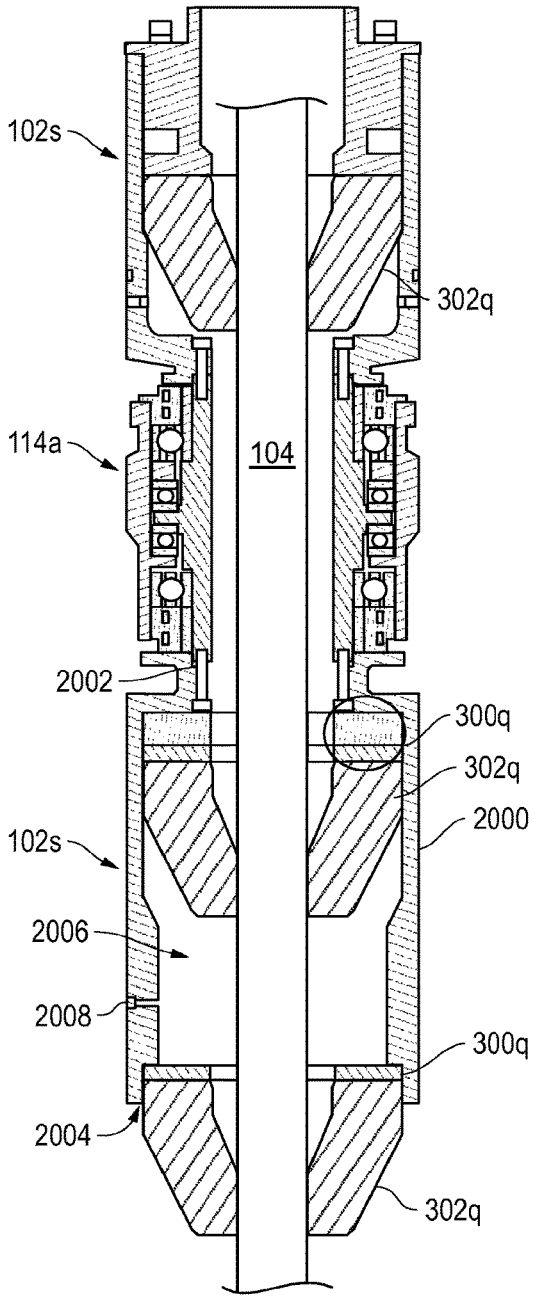
FIG. 20A depicts a cross sectional view of the seal in another embodiment.

FIG. 20A depicts a cross sectional view of a portion of the RCD 114*a* having the seal(s) 102*s* according to another embodiment. As shown, the seal(s) 102*s* have two frames 300*q* (shown schematically) and three seal members 302*q* (an upper-upper seal member 302*q* connected to the top end of the inner race 2002 is of the same size and shape as the seal members 302*q* below). Two of the seal members 302*q* (the lower two as shown) may be stacked in a seal adaptor 2000. The seal adaptor 2000 may be configured to couple the RCD 114 and the frames 300*q*. As shown, the seal adaptor 2000 couples below an inner race 2002 of the RCD 114*a*. The upper-lower seal member 302*q* may be located within the seal adaptor 2000, while the lower seal member 302*q* may hang below the seal adaptor 2000.

The seal adaptor 2000 may be configured to rotate with the seal member 302*q* relative to the RCD 114*a* in an embodiment. In an alternative embodiment, the seal adaptor 2000 may be rotationally fixed, and the seal members 302*q* may be configured to rotate in a support profile 2004 of the seal adaptor 2000. A seal adaptor cavity 2006 between the upper-lower and lower seal members 302*q* may be packed with grease, or other suitable fluid. The grease may be temperature sensitive relative to the flow with the RCD 114*a*. The grease may be injected into the seal adaptor cavity 2006 via one or more ports 2008 in the seal adaptor 2000.

In an embodiment, the centrifugal force may be used to force the grease toward the oilfield tool 104 during oilfield operations.

The seal members 302 may be the same or different seal members 302*q* depending on the oilfield operations being performed. In an embodiment, the seal members 302*q* are standard seal members. Further, the seal members 302*q* may be any combination of the seal members 300 described herein. Further the seal adapter 2000 to which both seal members are affixed may be constructed at least partially from horizontally corrugated material (not shown) in order to accommodate miss-alignment or bent oilfield equipment 104 and relieving some side loading from the bearing. The seal adaptor(s) 2000 (housings or cartridges) and/or frames 300*q* for the seal members 302*q* may, for example, be made of reinforced rubber.

Figure 20B:
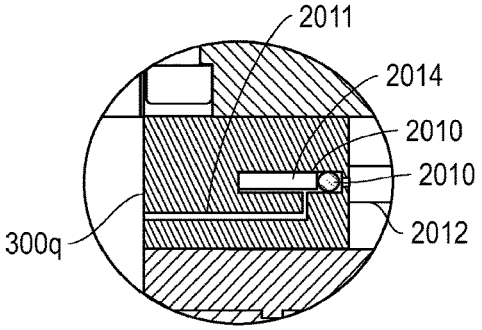
FIG. 20B depicts a cross sectional view of a portion of the seal in another embodiment related to FIG. 20A.

FIG. 20B depicts one embodiment of a portion of the seal 102*s*. In this embodiment, the one or more frames 300*q* and/or seal members 302*q* may have a relief valve 2010 (such as, for example, a check ball) in fluid communication with a relief port 2011. The relief valves 2010 with springs 2014, and filter media 2012, may be settable double acting relief valves that allow the seal adaptor cavity 2006 to fluidly communicate with the wellbore pressure. The fluid communication between the wellbore pressure and the seal adaptor cavity 2006 may achieve a degree of differential pressure sharing. Please see US patent publication number 2011/0024195 entitled "Drilling with a High Pressure RCD" the disclosure of which is hereby incorporated by reference. In another embodiment, the seal adaptor may have an open port (not shown) configured to fluidly communicate with the wellbore pressure. In this embodiment, the upper-lower seal member 302*q* may be exposed to a higher differential pressure while the lower seal member 302*q* may only be exposed to stripping mud with stretch tightness.

Figure 21:
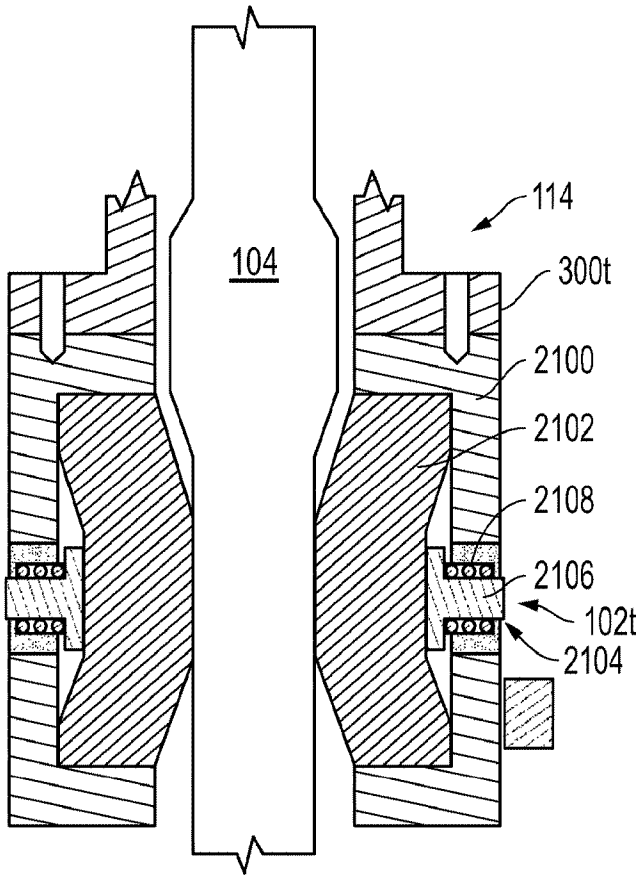
FIG. 21 depicts a cross sectional view of the seal in another embodiment.

FIG. 21 depicts a cross sectional view of the seal 102*t* according to another embodiment. The seal 102*t* has a mounting frame 300*t*, a seal housing 2100, a biased seal member 2102, and a biasing system 2104. The seal housing 2100 is configured to couple to the RCD 114 and house the biased seal member 2102. The biased seal member 2102 may be located within the seal housing 2100 and biased radially toward the oilfield equipment 104. As shown, the biased seal member 2102 is coupled to the housing at each end of the biased seal member 2102. The biased seal member 2102 may have strategically bonded areas to reduce the pressure effects from the wellbore 106 (as shown in FIG. 1). Further, the biased seal member 2102 may have steel reinforcement (not shown) in weak areas. The biasing system 2104 as shown is a piston 2106 (which may be assisted by wellbore pressure) biased by a coiled spring 2108 although it may be any suitable system including, but not limited to, an O-ring, a leaf spring, and the like. The biasing system biases the biased seal member 2102 into engagement with the oilfield equipment 104 during oilfield operations. The biased seal member 2102 may be constructed of and include any materials (e.g. elastomeric) and/or devices described in conjunction with the seal members 302 described herein.

Figure 22:
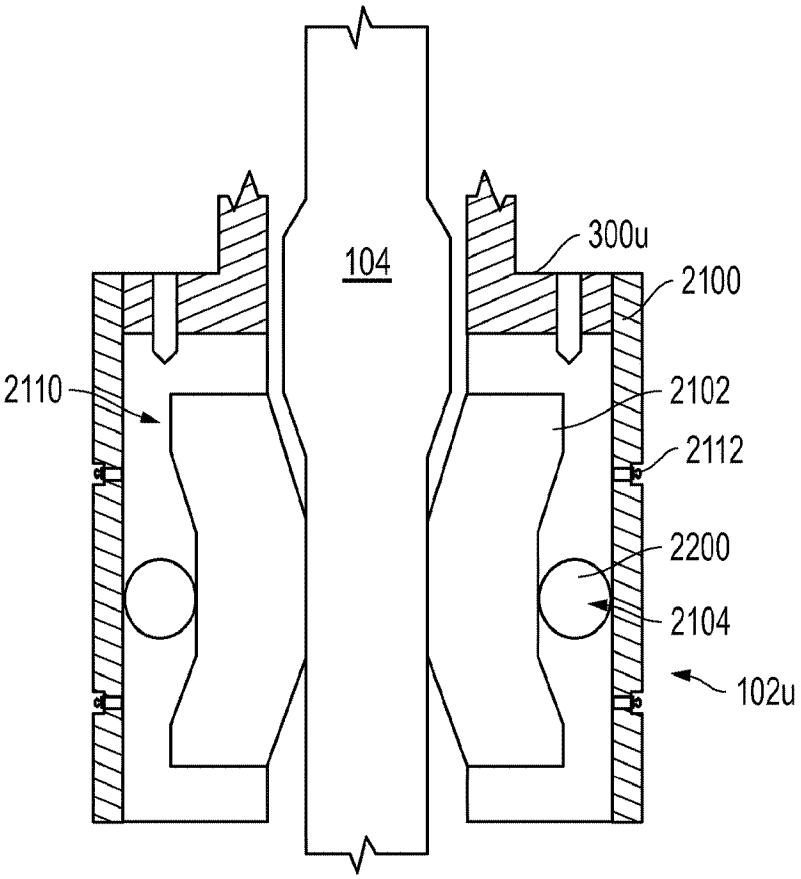
FIG. 22 depicts a cross sectional view of the seal in another embodiment.

FIG. 22 depicts the seal 102*u* in another embodiment. The seal 102*u* is similar to the seal 102*t* depicted in FIG. 21 and has a mounting frame 300*u*; however, the biasing system 2104 is an O-ring 2200. The O-ring 2200 may surround the biased seal element 2102. As shown, the O-ring 2200 is an elastic tube that may, for example, be surrounded by chamber 2110 pre-charged by hydraulics or pneumatics, for example an inert gas. The chamber 2110 may be pre-charged via ZIRK fitting 2112 with a pressure that biases the biased seal member 2102 into engagement with the oilfield equipment 104. As the temperature increases in the seal 102*u*, the gas in the chamber 2110 expands thereby increasing the bias on the biased seal member 2102.

Figure 23:
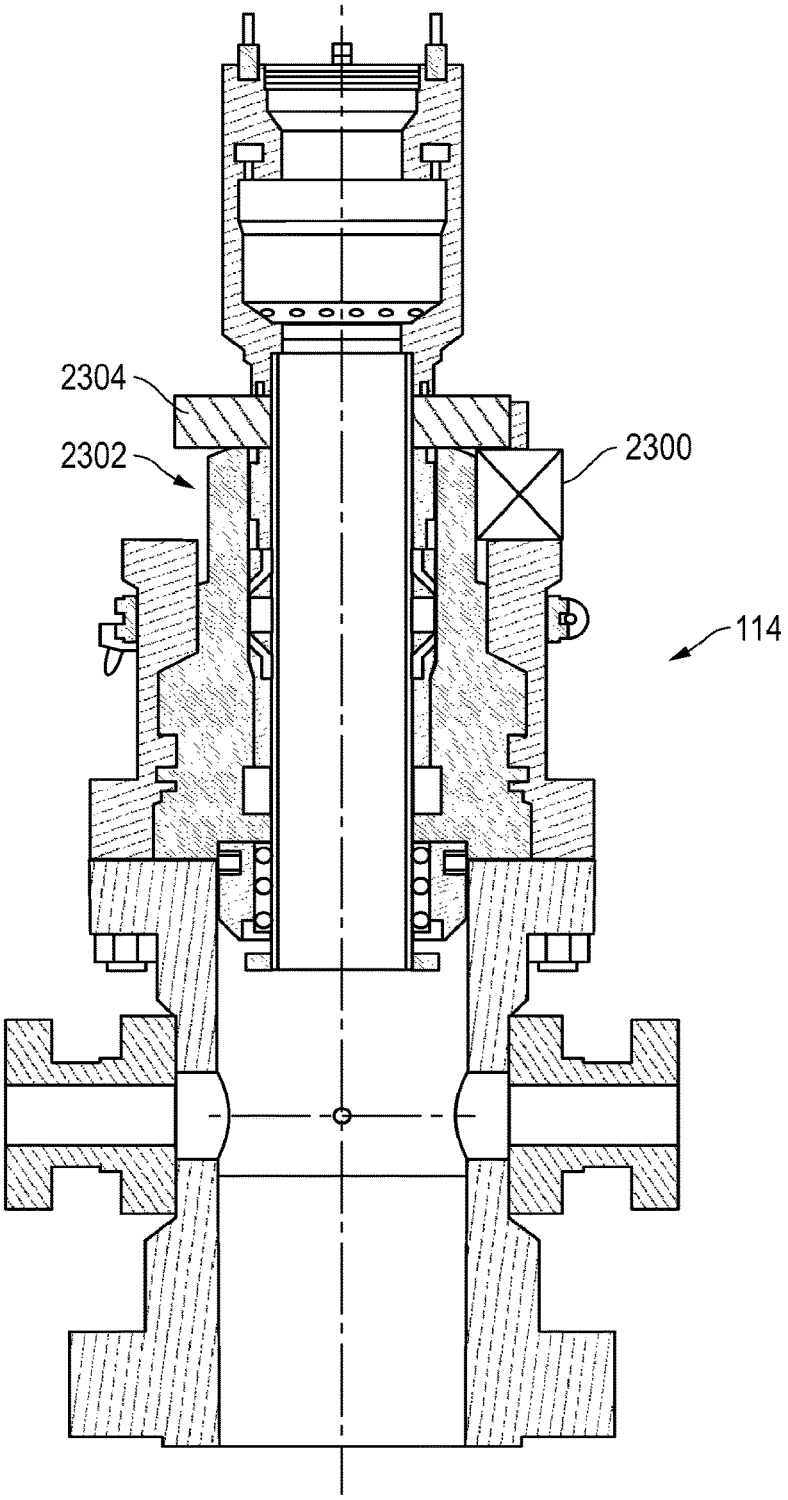
FIG. 23 depicts a cross sectional view of the seal in another embodiment.

FIG. 23 depicts an RCD 114 having a motor 2300 for rotating an inner barrel 2302 of the RCD 114. The motor 2300 is configured to positively/directly rotate the inner barrel, or race, 2302 at a rotational speed to match the top drive, or other rotation device, that rotates the oilfield equipment. The motor 2300 may be any suitable motor, or motive member, including, but not limited to, an electric motor, a hydraulic motor, a pneumatic motor and the like. The motor 2300 may be a variable speed motor configured to match the rotational speed of the oilfield equipment. One or more gears 2304 may be configured to transmit power from the motor 2300 to the inner barrel 2302. Further, the one or more gears 2304 may be configured to control the rotational speed of the inner barrel 2302. The one or more gears 2304 may be any suitable gears including, but not limited to, worm gears, toothed gears, a geared race, and the like. The power supply to the motor 2300 may be sourced and speed controlled from a hydraulic power unit of the RCD 114. The motor 2300 may be capable of rotating the inner barrel 2302 to any suitable RPM including, but not limited to, two hundred RPM with about 120 ft./lbs. (80.64 m kg) of torque capability.

The inner barrel 2302 may couple to the seal 102*s* as shown in FIGS. 20A and 20B. Further, the inner barrel 2302 may couple to any of the seals 102 described herein in order to rotate the seal 102 with the oilfield equipment. The motor 2300 may be configured to assist the seals 102 and/or the seal members 302 ability to rotate the inner barrel, or race. Further the motor 2300 may positively drive the inner barrel 2302 and thereby the seals 102 at a substantially similar rate as the oilfield equipment. This may substantially reduce wear on the seal members 302 during the life of the seals 102.

Figure 24:
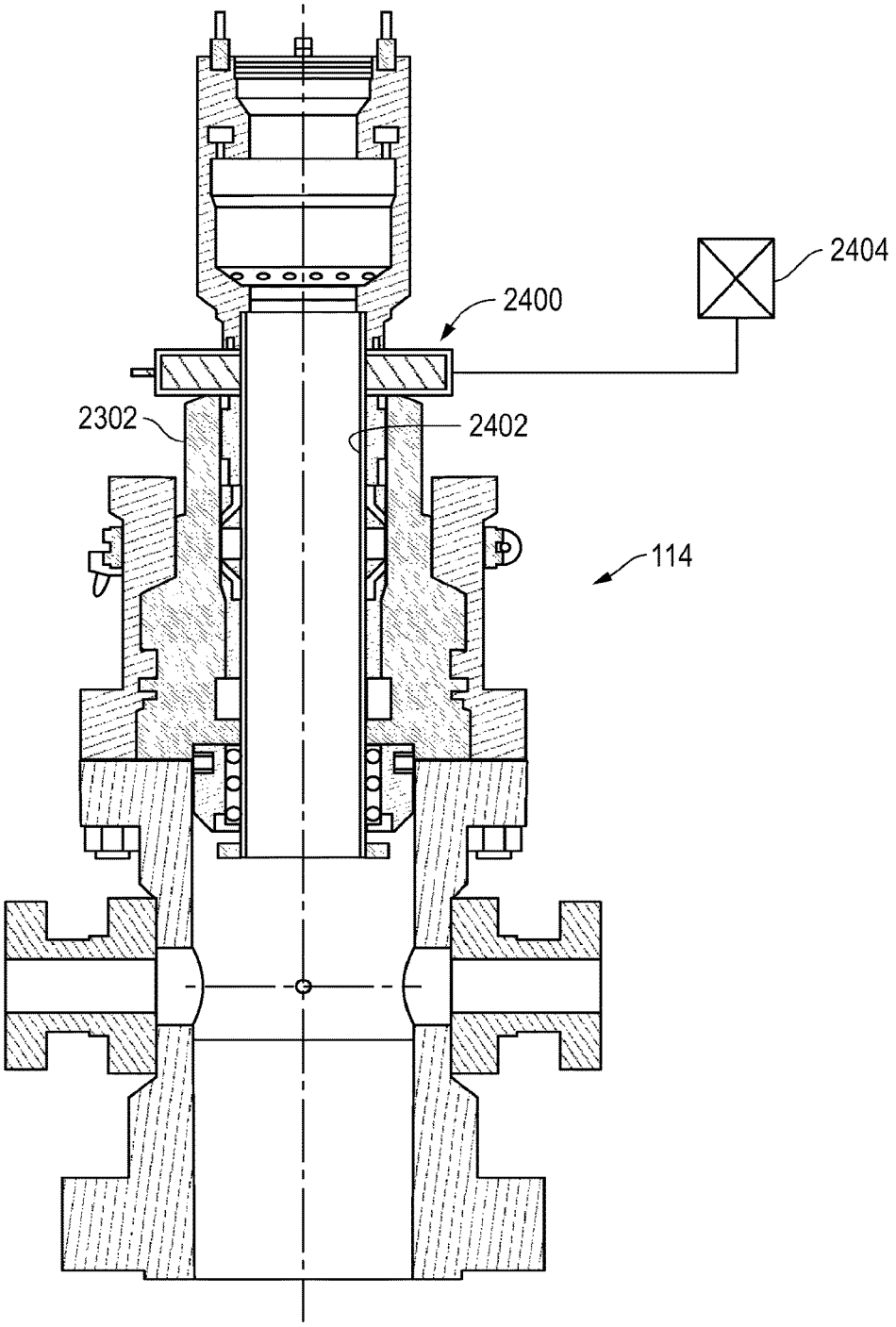
FIG. 24 depicts a cross sectional view of the seal in another embodiment.

FIG. 24 depicts the RCD 114 having one or more power transmission vanes 2400 configured to rotate the inner barrel 2302. In an embodiment, the seal 102*s* of FIGS. 20A and 20B may couple to the inner barrel 2302 and rotate therewith, although any of the seal described herein may be used in conjunction with the power transmission vanes 2400. The one or more power transmission vanes 2400 may be configured to couple to the outer diameter of the inner barrel 2302 and be affixed to the internal bearing 2402. As the one or more power transmission vanes 2400 rotate the inner bearing 2402 and thereby the one or more seals 102 are rotated. The one or more power transmission vanes 2400 may be similar to a turbine, or fan, that is powered by fluid flow against the vanes 2400.

As shown, A hydraulic power unit (HPU) 2404 may supply hydraulic fluid to the one or more power transmission vanes 2400 to rotate the power transmission vanes 2400 and thereby the seals 102. The flow rate and pressure of the HPU 2404 may be influenced directly by the rotational speed of the top drive. This configuration may assist the seal members 302 ability to rotate in the inner barrel as opposed to attempting to synchronize/match the inner barrel speed with the speed of the top drive. In an embodiment, the one or more power transmission vanes 2400 couple to the adaptor, or other race, located between an upper and lower seal 102 of a dual element RCD.

The components of the seals 102 described herein may be interchanged for all of the seal members 302 and frames 300 depending on the type of oilfield operations being performed.

While the embodiments are described with reference to various implementations and exploitations, it will be understood that these embodiments are illustrative and that the scope of the inventive subject matter is not limited to them. Many variations, modifications, additions and improvements are possible. For example, the techniques used herein may be applied to any downhole BOPs, ram shears, packers, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An annular seal for use in a well pressure control device, the annular seal comprising:

an annular seal member including an inner seal surface and an outer surface; and an annular reservoir adjacent and outwardly surrounding the annular seal member outer surface, the annular reservoir comprising an inflatable bladder.

2. The annular seal of claim 1, further comprising a lubricant disposed within the annular reservoir.

3. The annular seal of claim 2, wherein the lubricant flows to the inner seal surface in response to compression of the annular reservoir.

4. The annular seal of claim 2, wherein the lubricant flows to the inner seal surface in response to deformation of the seal member.

5. The annular seal of claim 1, wherein the annular seal member further includes a port that provides fluid communication between the inner seal surface and the annular reservoir.

6. The annular seal of claim 1, further comprising a frame configured to attach the seal member to an inner race of the well pressure control device.

7. The annular seal of claim 1, wherein the annular reservoir is connected to an accumulator.

8. The annular seal of claim 1, wherein the annular reservoir is configured to rotate with the seal member while the seal surface engages an item of oilfield equipment.

9. The annular seal of claim 1, wherein the annular reservoir is configured to remain stationary with the seal member as the seal surface engages a rotating item of oilfield equipment.

10. A pressure control device for sealing about an item of oilfield equipment, the pressure control device comprising:

an annular seal, the annular seal comprising an annular seal member including an inner seal surface for sealing against the item of oilfield equipment, a lubricant reservoir outwardly surrounding the annular seal member, and a lubricant disposed in the lubricant reservoir, wherein the lubricant flows to the inner seal surface in response to deformation of the seal member.

11. The pressure control device of claim 10, wherein the lubricant reservoir comprises an inflatable bladder.

12. The pressure control device of claim 10, wherein the lubricant flows to the inner seal surface in response to compression of the lubricant reservoir.

13. The pressure control device of claim 10, wherein the annular seal member further includes a port that provides fluid communication between the inner seal surface and the lubricant reservoir.

14. The pressure control device of claim 10, wherein the annular seal further comprises a frame configured to attach the seal member to an inner race of the pressure control device.

15. The pressure control device of claim 10, wherein the lubricant reservoir is connected to an accumulator.

16. The pressure control device of claim 10, wherein the lubricant reservoir is configured to rotate with the seal member while the seal surface engages the item of oilfield equipment.

17. The pressure control device of claim 10, wherein the lubricant reservoir is configured to remain stationary with the seal member as the seal surface engages the rotating item of oilfield equipment.

18. An annular seal for use in a well pressure control device, the annular seal comprising:

an annular seal member including an inner seal surface configured to sealingly engage an item of oilfield equipment;

a port formed through the inner seal surface, wherein the port receives a lubricant that flows through a material of the seal member to the inner seal surface; and a lubricant reservoir that rotates with the seal member.

19. The annular seal of claim 18, in which the inner seal surface completely surrounds the port.

20. The annular seal of claim 18, in which the lubricant reservoir comprises a bladder.

21. The annular seal of claim 18, in which the lubricant flows to the inner seal surface in response to compression of the lubricant reservoir.

22. The annular seal of claim 18, in which the lubricant flows to the inner seal surface in response to deformation of the seal member.

23. The annular seal of claim 18, further comprising a frame configured to attach the seal member in the well pressure control device, the lubricant reservoir being formed at least partially in the frame.

24. The annular seal of claim 18, in which the lubricant reservoir outwardly surrounds the seal member.

25. The annular seal of claim 18, in which the lubricant reservoir is formed at least partially in the material of the seal member.

26. A method of sealing about an item of oilfield equipment, the method comprising:

sealingly engaging the item of oilfield equipment with an annular seal of a pressure control device, the annular seal comprising an annular seal member including an inner seal surface that seals against the item of oilfield equipment;

flowing a lubricant from a lubricant reservoir to the inner seal surface via a port formed through the inner seal surface; and rotating the lubricant reservoir with the seal member while the inner seal surface engages the item of oilfield equipment.

27. The method of claim 26, in which the lubricant reservoir comprises a bladder.

28. The method of claim 26, in which the lubricant flows to the inner seal surface in response to compression of the lubricant reservoir.

29. The method of claim 26, in which the lubricant flows to the inner seal surface in response to deformation of the seal member.

30. The method of claim 26, in which a material of the seal member surrounds the port.

31. The method of claim 26, in which the annular seal further comprises a frame configured to attach the seal member in the pressure control device, and further comprising forming the lubricant reservoir in at least one of the seal member and the frame.

32. The method of claim 26, in which the lubricant reservoir outwardly surrounds the seal member.

33. The method of claim 26, in which the lubricant reservoir remains stationary with the seal member as the inner seal surface engages the item of oilfield equipment and as the item of oilfield equipment rotates.

* * * * *